US008867939B2

(12) United States Patent
Shibuya

(10) Patent No.: US 8,867,939 B2
(45) Date of Patent: Oct. 21, 2014

(54) IMAGE FORMING APPARATUS

(75) Inventor: Kenichi Shibuya, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 181 days.

(21) Appl. No.: 13/309,805

(22) Filed: Dec. 2, 2011

(65) Prior Publication Data

US 2012/0155896 A1 Jun. 21, 2012

(30) Foreign Application Priority Data

Dec. 17, 2010 (JP) ..... 2010-282444

(51) Int. Cl.

| | |
|---|---|
| ***G03G 15/02*** | (2006.01) |
| ***G03G 21/16*** | (2006.01) |
| ***G03G 15/00*** | (2006.01) |
| ***G03G 15/043*** | (2006.01) |

(52) U.S. Cl.

CPC ..... *G03G 15/0275* (2013.01); *G03G 21/1671* (2013.01); *G03G 15/5033* (2013.01); *G03G 15/043* (2013.01); *G03G 15/505* (2013.01); *G03G 2215/0008* (2013.01)

USPC ..... 399/50; 399/128

(58) Field of Classification Search

USPC ..... 399/45, 50, 128, 174, 176

See application file for complete search history.

(56) References Cited

U.S. PATENT DOCUMENTS

| | | | |
|---|---|---|---|
| 5,671,468 | A | 9/1997 | Yamamoto et al. |
| 7,469,109 | B2 | 12/2008 | Shibuya |
| 2004/0223784 | A1 | 11/2004 | Nakahara et al. |
| 2010/0008685 | A1 | 1/2010 | Shibuya |
| 2010/0239287 | A1 | 9/2010 | Shibuya |

FOREIGN PATENT DOCUMENTS

| | | | |
|---|---|---|---|
| JP | 5-341626 | A | 12/1993 |
| JP | 2007-047670 | A | 2/2007 |

OTHER PUBLICATIONS

Chinese Office Action dated Jan. 30, 2014, in related Chinese Patent Application No. 201110424088.6 (with English translation).

*Primary Examiner* — Walter L Lindsay, Jr.
*Assistant Examiner* — Barnabas Fekete
(74) *Attorney, Agent, or Firm* — Fitzpatrick, Cella, Harper & Scinto

(57) ABSTRACT

An image forming apparatus includes a rotatable photosensitive member, and a charging member for electrically charging the photosensitive member in contact or proximity to the photosensitive member. The charging member forms an upstream gap and a downstream gap between the photosensitive member and itself. In addition, a power source applies a DC voltage to the charging member, an irradiation unit irradiates with light a surface of the photosensitive member in the upstream gap, and a controller controls the irradiation of the light by the irradiation unit. The photosensitive member is movable at a first speed and a second speed slower than the first speed, and wherein the irradiation of the light is effected when the photosensitive member is moved at the first speed to effect image formation, and is not effected when the photosensitive member is moved at the second speed to effect the image formation.

5 Claims, 12 Drawing Sheets

(a)

(b)

IMAGE FORMING APPARATUS

FIELD OF THE INVENTION AND RELATED ART

The present invention relates to an image forming apparatus of an electrophotographic type, such as a copying machine, a printer or a facsimile machine.

In recent years, in the image forming apparatus of the electrophotographic type, in order to electrically charge an electrophotographic photosensitive member, a contact charging type in which a charging member of a roller type or a blade type is brought into contact with the member to charge the photosensitive member has been used. In order to charge the photosensitive member by the contact charging type, two methods have been well known. One is an "AC charging type" in which the photosensitive member is charged by applying a superimposed voltage of a DC voltage and an AC voltage to the charging member. The other is a "DC charging type" in which the photosensitive member is charged by applying only the DC voltage to the charging member.

In the "AC charging type", the AC voltage is applied and therefore can uniformly charge the surface of the photosensitive member relative to the "DC charging type". On the other hand, compared with the "DC charging type", in the "AC charging type", an amount of (electric) discharge on the photosensitive member is increased and therefore the photosensitive member surface is liable to be abraded. For that reason, when the photosensitive member is charged by using the "AC charging type", a lifetime of the member is shortened compared with the case where the member is charged by using the "DC charging type". Further, the "AC charging type", requires an AC power source. For that reason, an initial cost and a running cost of the "AC charging type" are high relative to those of the "DC charging type". In other words, the "DC charging type" is, compared with the "AC charging type" advantageous in terms of the running cost and the initial cost.

However, compared with the "AC charging type", the "DC charging type" is deteriorated in uniformity of a surface potential (charging uniformity) of the member in some cases. Specifically, when a system including a photosensitive drum and a charging roller contacting the photosensitive drum to form a contact portion is described, there is a problem of a stripe-like charging non-uniformity, extending in a longitudinal direction (perpendicular to a circumferential direction of the photosensitive drum, resulting from non-uniformity of the surface potential of the photosensitive drum (hereinafter referred to as a "charging lateral stripe"). It would be considered that this is attributable to an occurrence of unstable minute electric discharge (separation discharge or the like) between the charging roller and the photosensitive drum charged in a minute gap voltage of the contact portion with respect to a rotational direction of the photosensitive drum, in a minute gap downstream of the contact portion with respect to the photosensitive drum rotational direction.

Here, the minute gap between the photosensitive member and the charging member is referred to as "charging gap". Further, of the above charging gaps, the charging gap upstream of the contact portion with respect to a movement direction of the surface (charged surface) of the photosensitive member is referred to as an "upstream charging gap", and the charging gap downstream of the contact portion is referred to as "downstream charging gap".

In Japanese Laid-Open Patent Application (JP-A) Hei 5-341626, a constitution for suppressing the "charging lateral stripe" occurring when the member is charged by using the "DC charging type" is disclosed. Specifically, the photosensitive member is irradiated with light in the upstream charging gap (nip pre-exposure) and thus charging of the member is cancelled in the upstream charging gap, so that the member is charged in the downstream charging gap. As a result, the occurrence of the charging lateral stripe due to the unstable minute electric discharge (separation discharge or the like) in the downstream charging gap is suppressed.

On the other hand, the image forming apparatus of the electrophotographic type has been required to meet image formation on various media. Further, when the image is formed on the various media, a constitution in which a process speed is changed depending on the type of the media has been widely employed. Here, the process speed of the image forming apparatus corresponds to the surface movement speed of the photosensitive member (circumferential speed of the photosensitive drum).

More specifically, when a toner image is fixed on thick paper, heat in a large amount is required in order to ensure a fixing property comparable to that when the toner image is fixed on the photosensitive drum. Therefore, in order to provide the thick paper with heat in the large amount, a constitution in which a fixing speed of a fixing device is slowed and thus a heating time is prolonged is known. Further, a constitution in which the slowing of the fixing speed of the fixing device, the surface movement speed of the photosensitive member is slowed similarly as in the case of the fixing speed of the fixing device is also known.

However, such an image forming apparatus in which the surface movement speed of the photosensitive member is changeable, when the photosensitive member is irradiated with certain light in the upstream charging gap, it was turned out that there arose a problem that the charging lateral stripe occurred irrespective of the movement speed. Specifically, the charging lateral stripe occurred when light quantity for exposure of the photosensitive member in the upstream during image formation on the plain paper is equal to light quantity for exposure of the photosensitive member in the upstream charging gap during image formation on the thick paper. It would be considered that this is because the photosensitive member is sufficiently charged in the upstream charging gap even in the case where the photosensitive member is charge-removed by the light in the upstream charging gap when the surface movement speed of the photosensitive member is slowed and therefore the unstable minute electric discharge (separation discharge or the like) occurs in the downstream charging gap.

SUMMARY OF THE INVENTION

A principal object of the present invention is to provide an image forming apparatus, in which a surface movement speed of a photosensitive member is changeable and a DC charging type is employed, capable of suppressing a stripe-like image non-uniformity due to a charging process of the member irrespective of the surface movement speed of the photosensitive member.

According to an aspect of the present invention, there is provided an image forming apparatus comprising: a rotatable photosensitive member; a charging member for electrically charging the photosensitive member in contact or proximity to the photosensitive member, wherein the charging member forms an upstream gap and a downstream gap between the photosensitive member and itself, with respect to a movement direction of the photosensitive member, so that the upstream gap is gradually narrowed toward a contact portion or a closest position between the photosensitive member and itself and so that the downstream gap is gradually widened with a distance from the contact portion or the closest position; a power source for applying a DC voltage to the charging member; irradiation means for irradiating with light a surface of the photosensitive member in the upstream gap; and control means for controlling the irradiation of the light by the irradiation means, wherein the photosensitive member is movable at a first speed and a second speed slower than the first speed, and wherein the irradiation of the light by the irradiation means is effected when the photosensitive member is moved at the first speed to effect image formation, and is not effected when the photosensitive member is moved at the second speed to effect the image formation.

These and other objects, features and advantages of the present invention will become more apparent upon a consideration of the following description of the preferred embodiments of the present invention taken in conjunction with the accompanying drawings.

Figure 3:
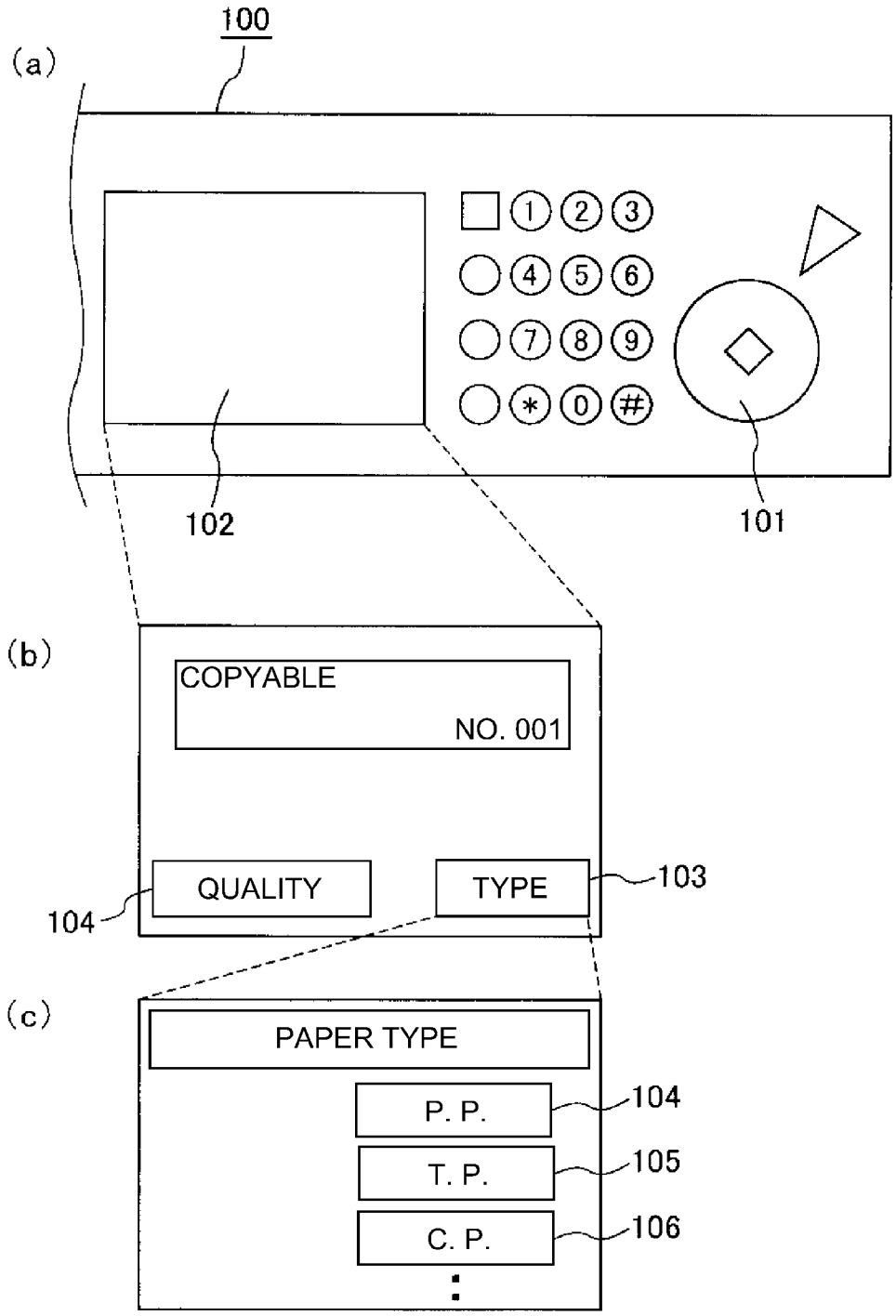

Parts (a), (b) and (c) of FIG. 3 are schematic views showing an operating portion of the image forming apparatus in the embodiment of the present invention.

Figure 4:
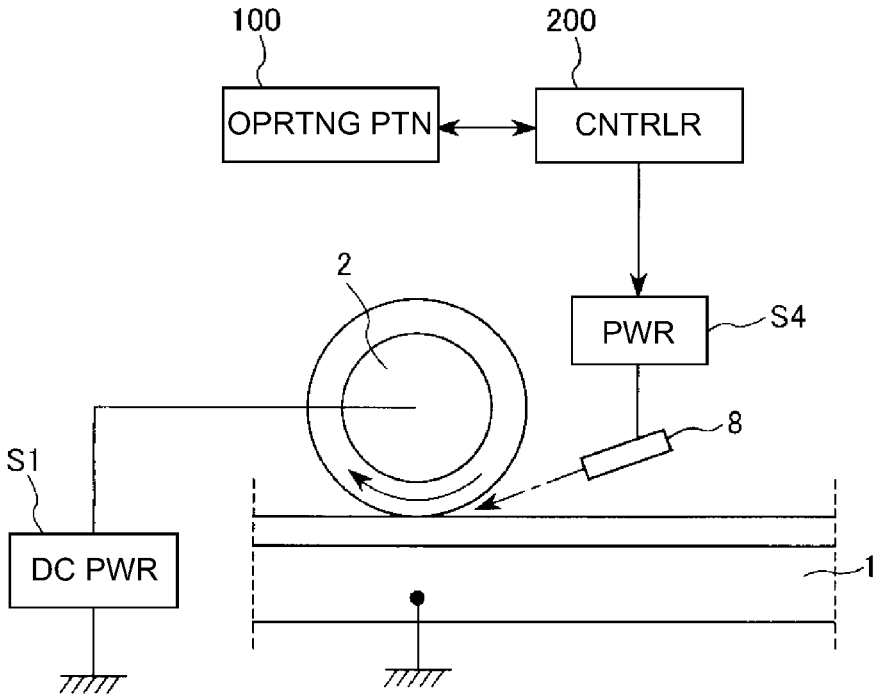

FIG. 4 is a block diagram of a principal part of the image forming apparatus in the embodiment of the present invention.

Figure 5:
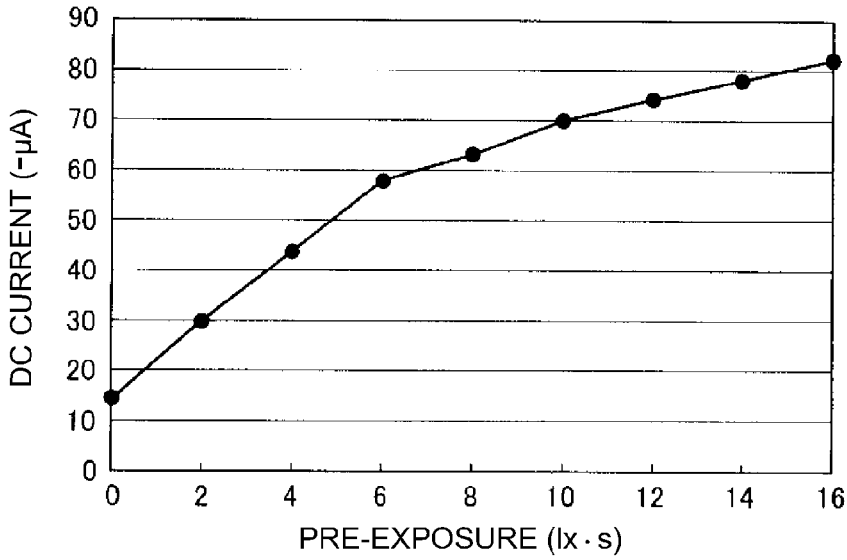
Figure 5:
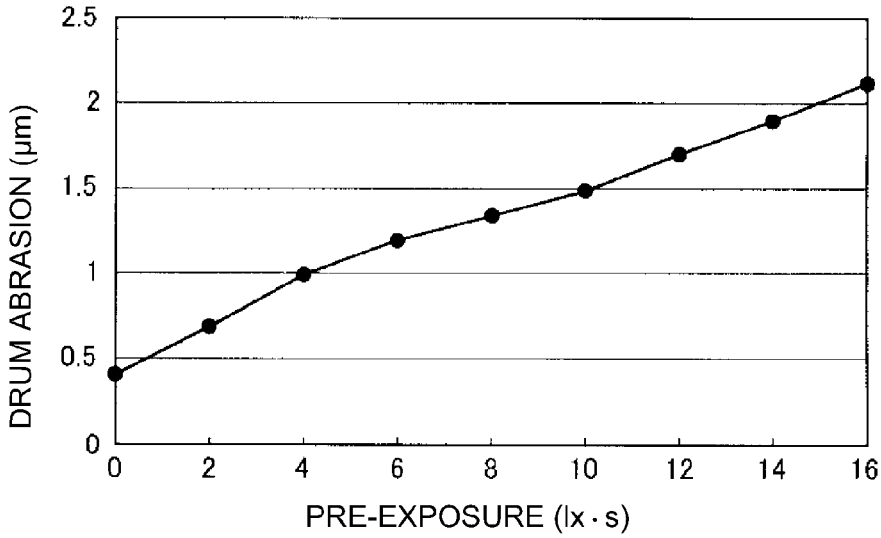

Part (a) of FIG. 5 is a graph showing a relationship between an amount of nip pre-exposure and a value of current flowing between the charging roller and the photosensitive drum, and (b) of FIG. 5 is a graph showing a relationship between the nip pre-exposure amount and an amount of abrasion of the photosensitive drum.

Figure 6:
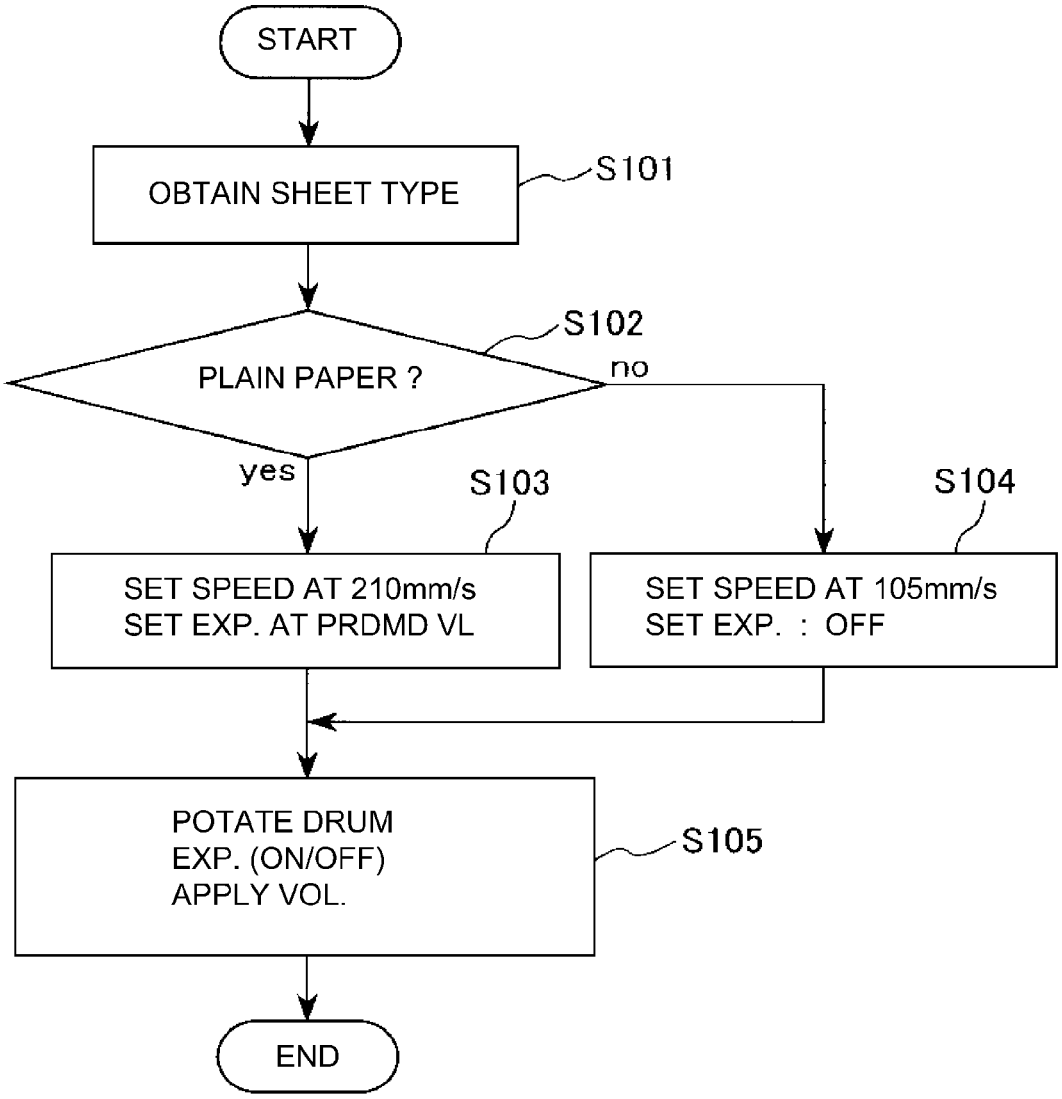

FIG. 6 is a flow chart for illustrating an example of an operation of the image forming apparatus according to the present invention.

Figure 7:
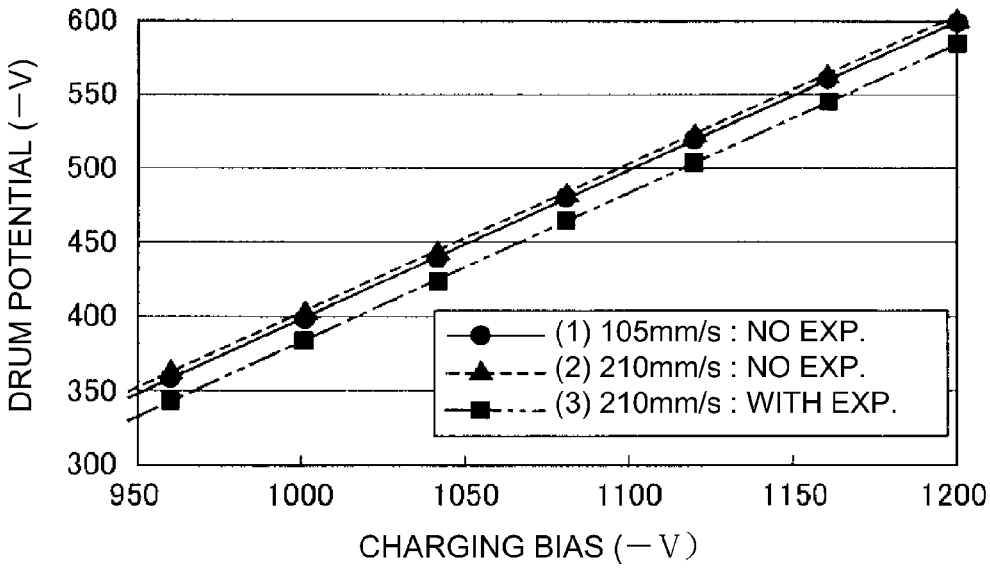

FIG. 7 is a graph for illustrating a relationship between presence/absence of the nip detect and a charge potential of the photosensitive drum at a developing portion.

Figure 8:
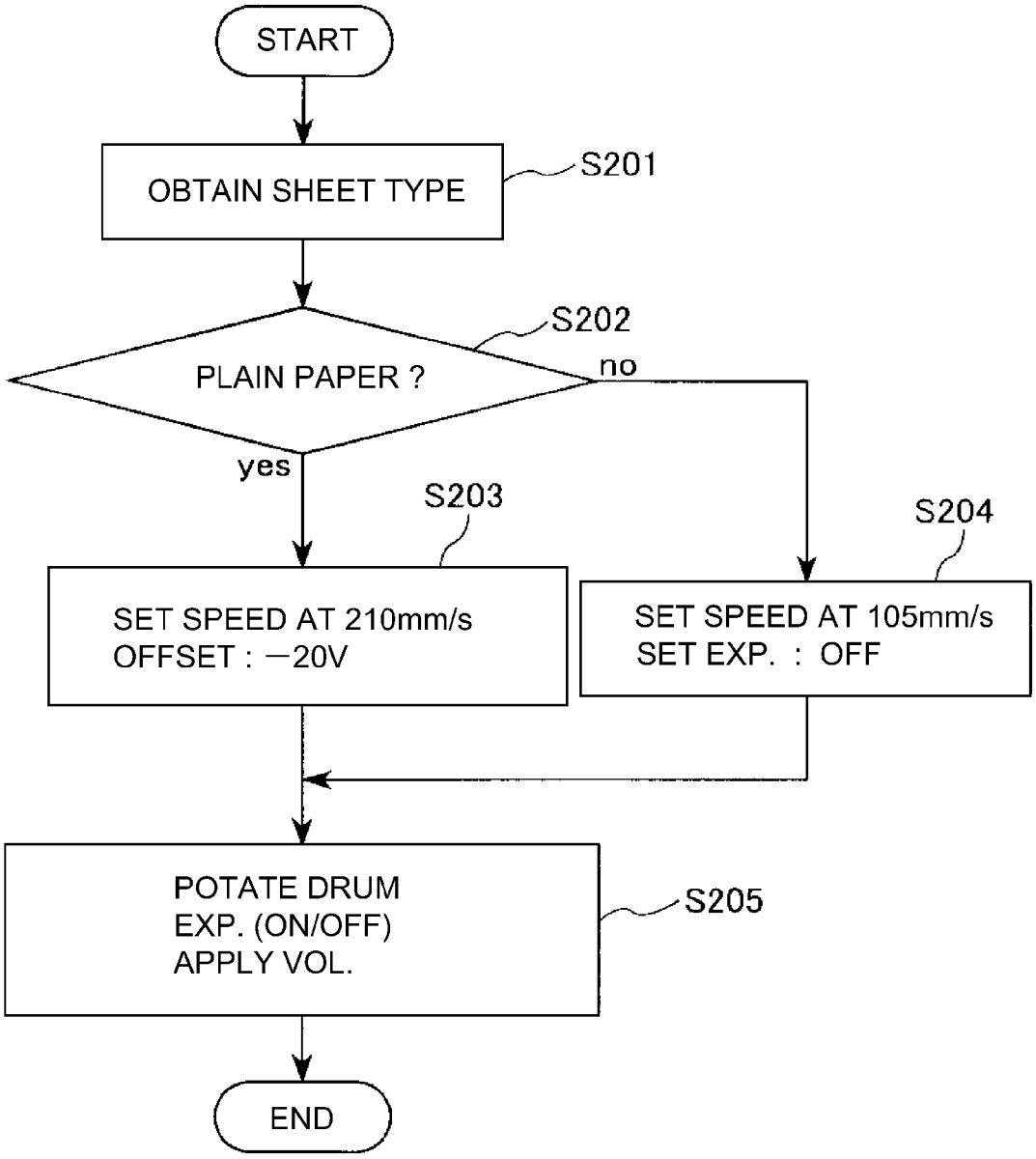

FIG. 8 is a flow chart for illustrating another example of the operation of the image forming apparatus according to the present invention.

Figure 9:
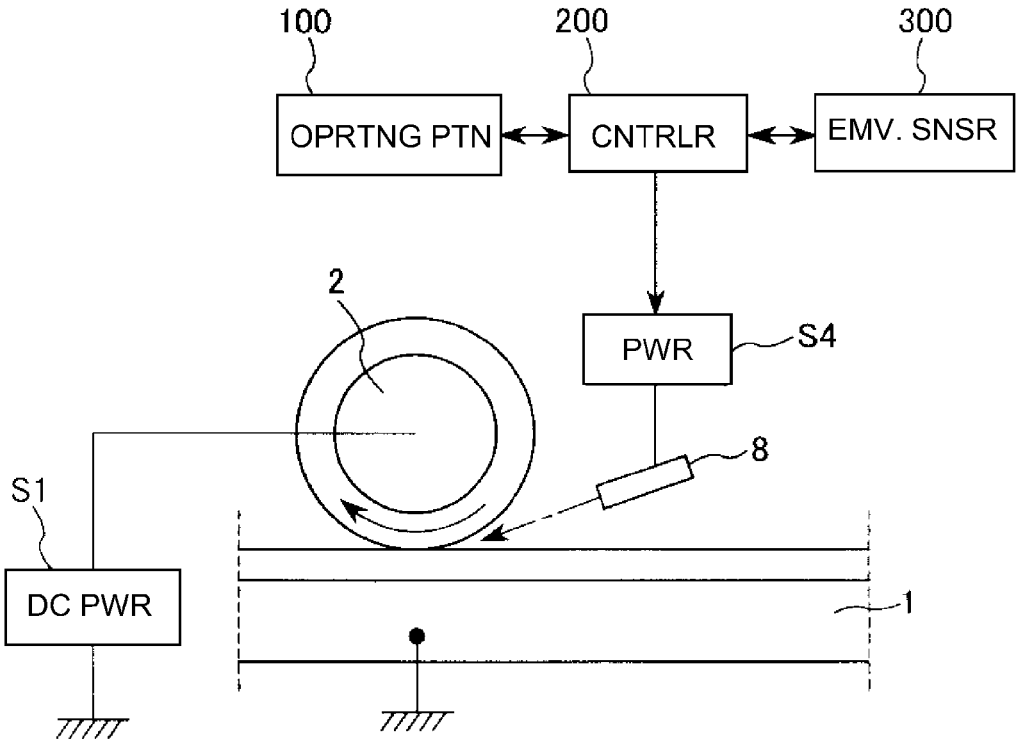

FIG. 9 is a block diagram of a principal part of an image forming apparatus according to another embodiment of the present invention.

Figure 10:
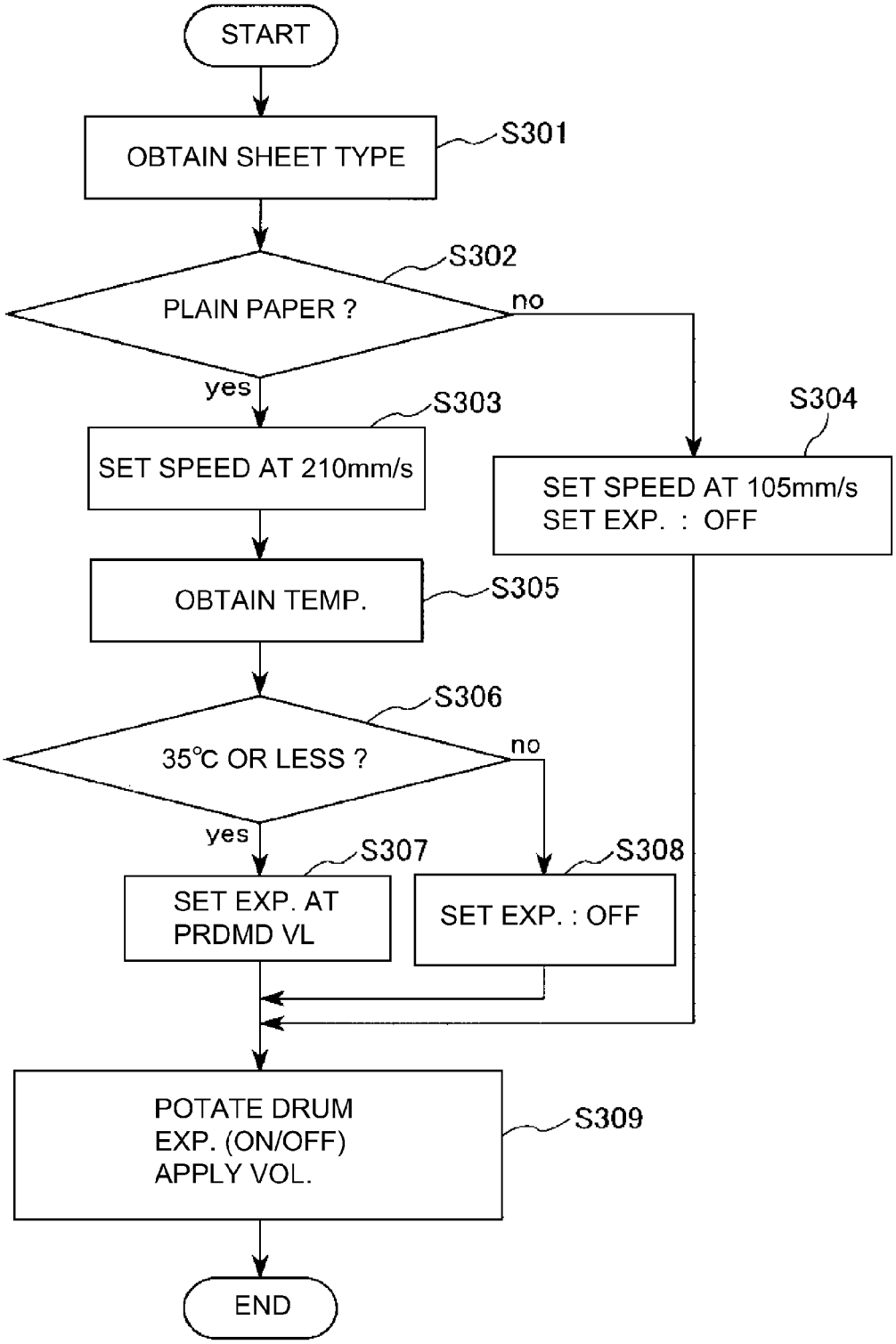

FIG. 10 is a flow chart for illustrating a further example of the operation of the image forming apparatus according to the present invention.

Figure 11:
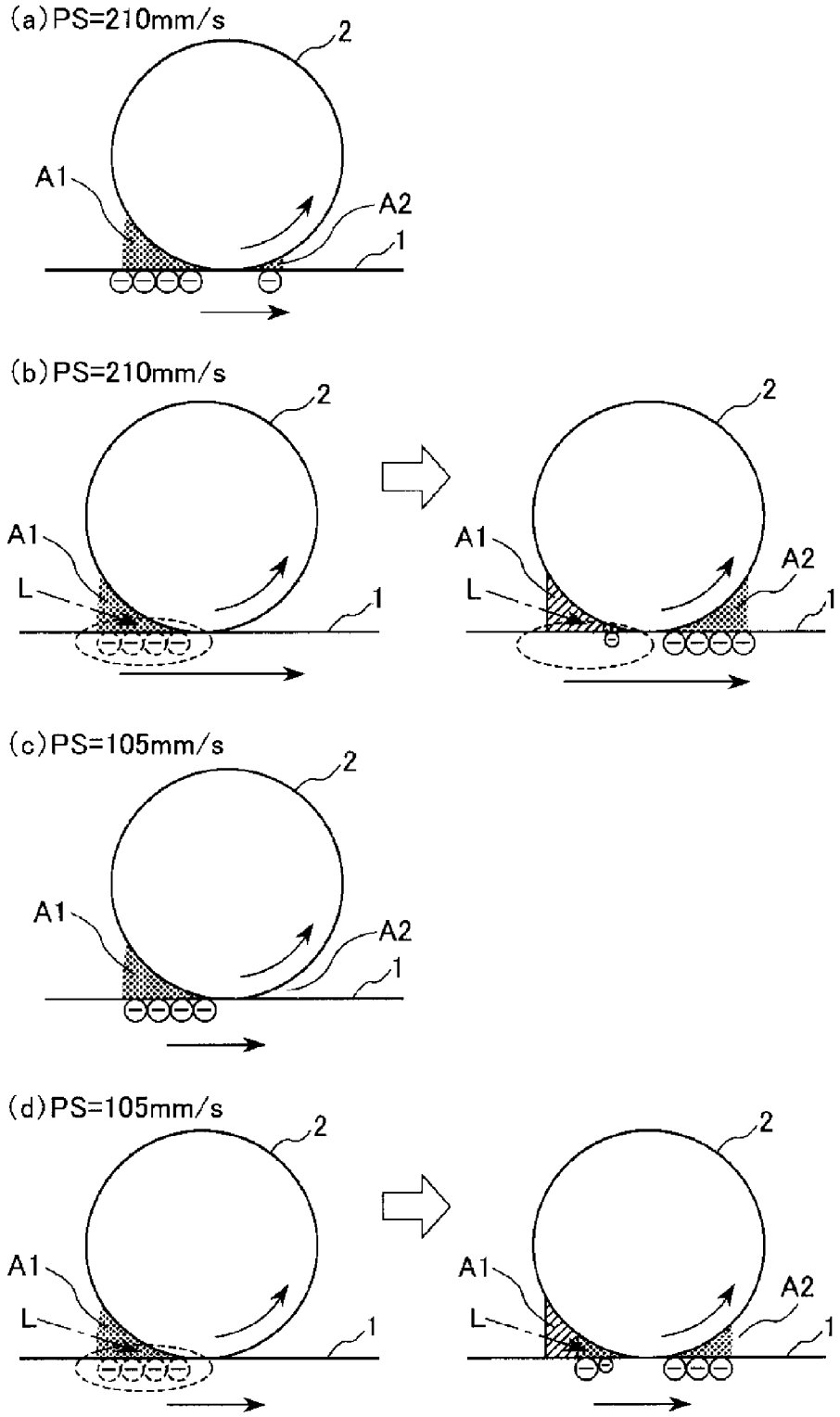

Parts (a), (b), (c) and (d) of FIG. 11 are schematic views for illustrating a still further example of the operation of the image forming apparatus according to the present invention.

Figure 12:
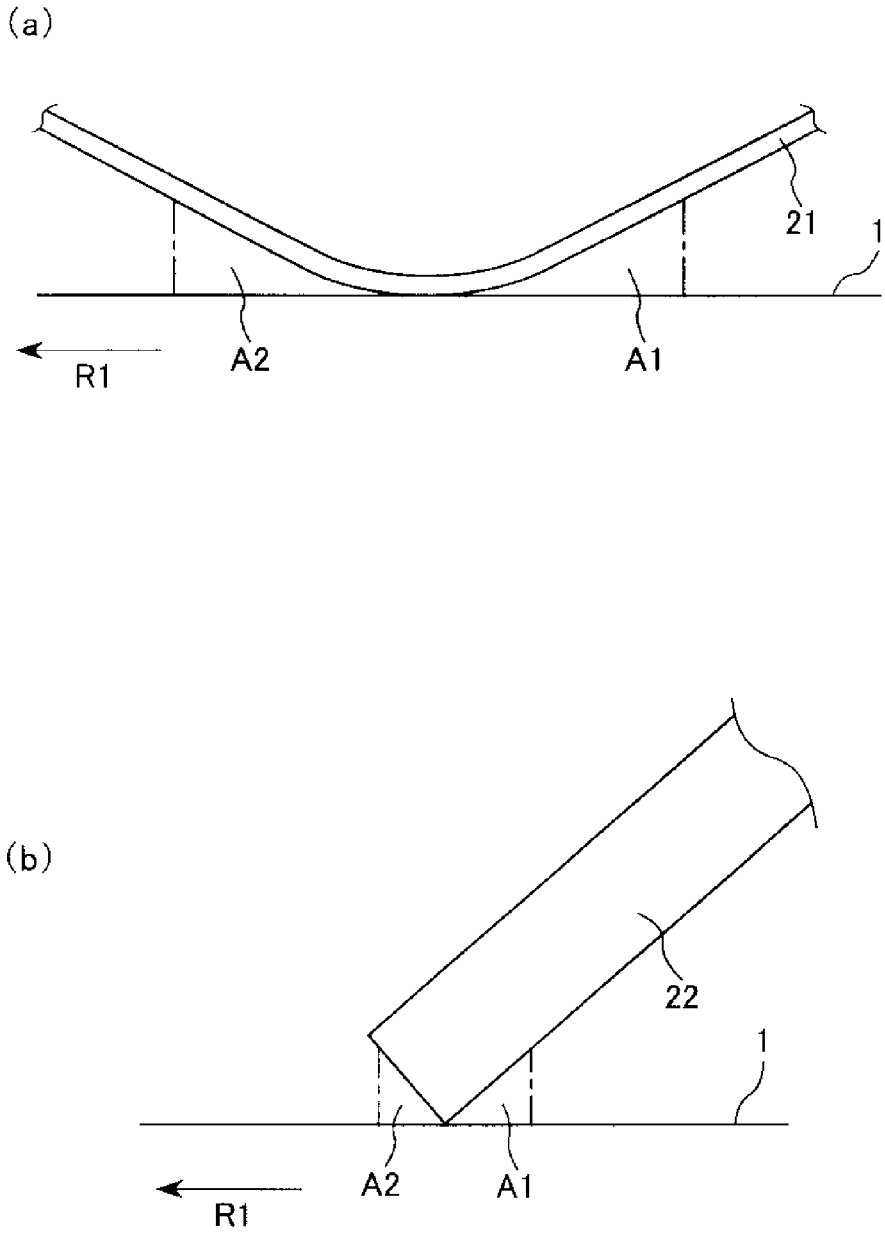

Parts (a) and (b) of FIG. 12 are schematic views for illustrating another example of the charging member.

DESCRIPTION OF THE PREFERRED EMBODIMENTS

The image forming apparatus according to the present invention will be described below more specifically with reference to the drawings.

(Embodiment 1)

1. General Structure and Operation of Image Forming Apparatus

Figure 1:
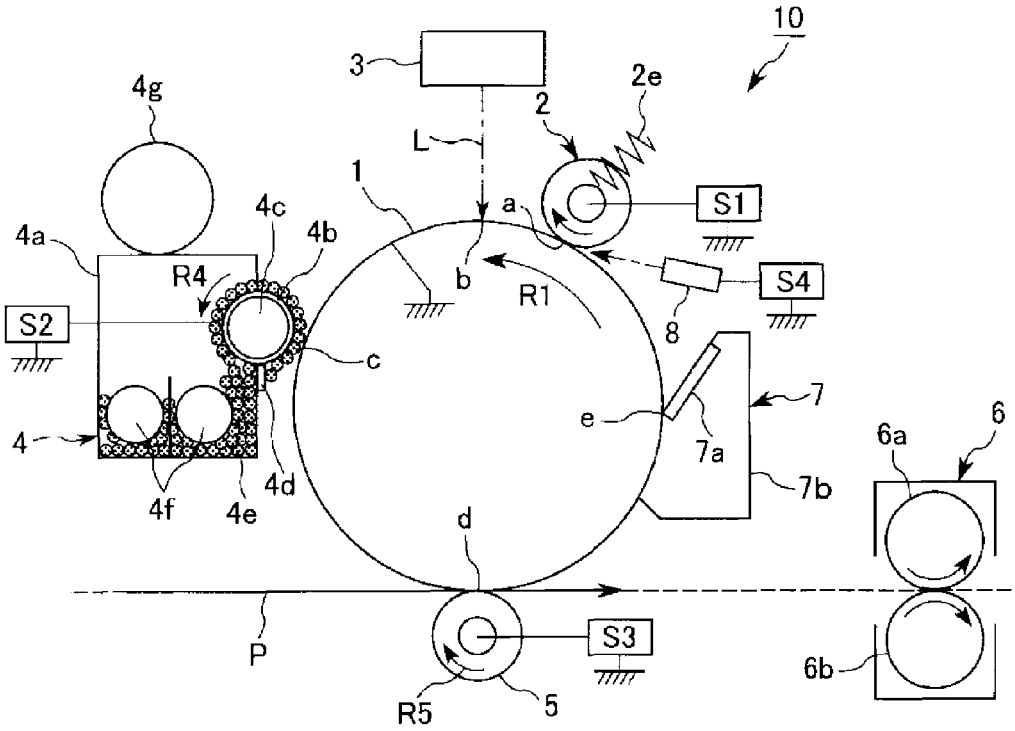
FIG. 1 is a schematic view showing a schematic structure of an image forming apparatus according to an embodiment of the present invention.

First, a general structure and operation of the image forming apparatus according to an embodiment of the present invention will be described. FIG. 1 schematically illustrates the general structure of an image forming apparatus 10 in this embodiment. In this embodiment, the image forming apparatus 10 is an electrophotographic laser beam printer, capable of forming an image on paper with an A3 size at the maximum, which employs a contact charging type in which a charging roller is contacted to the photosensitive drum and a reverse development type in which an area in which a toner image is intended to be formed is subjected to light exposure.

The image forming apparatus 10 includes a drum-shaped electrophotographic photosensitive member as an image bearing member, i.e., a photosensitive drum 1. The photosensitive drum 1 is rotationally driven in an arrow R1 direction (counterclockwise direction). Around the photosensitive drum 1, along a rotational direction thereof, the following means are provided. First, a charging roller 2 which is a roller type charging member (contact charging member) as a charging means is disposed. Next, an exposure device (laser beam scanner) 3 as an exposure means (latent image forming means) is disposed. Next, a developing device 4 as a developing means is disposed. Next, a transfer roller 5 which is a roller type transfer member as a transfer means is disposed. Next, a cleaning device 7 as a cleaning means is disposed. The exposure device 3 is provided above a position between the charging roller 2 and the developing device 4.

With respect to the rotational direction of the photosensitive drum 1, a contact portion (charging nip) a between the charging roller 2 and the photosensitive drum 1, and an upstream charging gap A1 (FIG. 2) and a downstream charging gap A2 (FIG. 2) described later are a charging portion (charging position). With respect to the rotational direction of the photosensitive drum 1, an exposure position of the photosensitive drum 1 by the exposure device 3 is an exposure portion (exposure position) b. With respect to the rotational direction of the photosensitive drum 1, an opposing position in which a developing sleeve 4*b* described later of the developing device 4 opposes the photosensitive drum 1 is developing portion (developing position) c. With respect to the rotational direction of the photosensitive drum 1, a contact portion between the transfer roller 5 and the photosensitive drum 1 is a transfer portion (transfer position) d. Further, with respect to the rotational direction of the photosensitive drum 1, a contact portion between a cleaning blade 7*a* described later of the cleaning device 7 and the photosensitive drum 1 is cleaning portion (cleaning position) e. These contact portion (charging nip) a, exposure portion b, develop portion c, transfer portion d and cleaning portion e are provided in this order with respect to the rotational direction of the photosensitive drum 1.

Further, downstream of the transfer portion d with respect to a conveyance direction of a transfer material P, a fixing device 6 as a fixing means is provided.

Further, at a periphery of the photosensitive drum 1, a nip pre-exposure device 8 as an irradiation means described later more specifically is provided.

During image formation, the surface (to be charged) of the photosensitive drum 1 is uniformed charged by the charging roller 2. Thereafter, the charged surface of the photosensitive drum 1 is subjected to scanning exposure at the exposure portion b by the exposure device 3 depending on image information. As a result, an electrostatic latent image (electrostatic image) depending on the image information is formed on the photosensitive drum 1. The electrostatic latent image formed on the photosensitive drum 1 is developed into a toner image at the developing portion c with a toner as a developer by the developing device 4. The toner image formed on the photosensitive drum 1 is electrostatically transferred at the transfer portion d onto the transfer material P, separately conveyed to the transfer portion d, by the action of the transfer roller 5. The transfer material P on which the toner image is transferred is separated from the photosensitive drum 1 and is then conveyed to the fixing device 6. The fixing device 6 applies heat and pressure to the transfer material P to fix the toner image thereon. Thereafter, the transfer material P is discharged from the image forming apparatus 10 as a print (image-formed product).

1-1. Photosensitive Member

Figure 2:
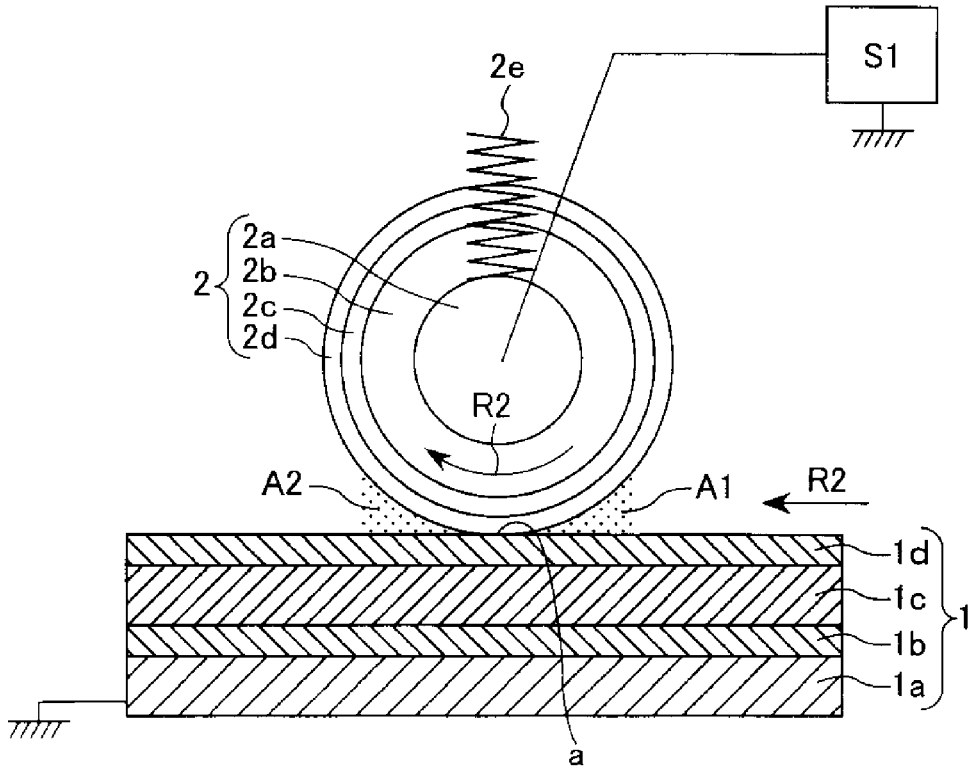
FIG. 2 is a schematic view of an example of a layer structure of a photosensitive drum and a layer structure of a charging roller.

The photosensitive drum 1 is the image bearing member on which the electrostatic latent image is to be formed. In this embodiment, the photosensitive drum 1 is a negatively chargeable organic photoconductor (OPC) drum of 30 mm in outer diameter. The photosensitive drum 1 receives a driving force from a motor (not shown) as a driving device to be rotated in the arrow R1 direction. The photosensitive drum 1 is, as shown in FIG. 2, constituted by applying, onto the surface of an aluminum cylinder (electroconductive drum support) 1*a*, three layers consisting of an undercoat layer 1*b* for suppressing light interference and improving an adhesive property to an upper layer, a photocharge generating layer 1*c* and a charge transporting layer 1*d* in this order.

In this embodiment, when the image is formed on the photosensitive drum (basis weight: 50-100 g/m$^2$), the photosensitive drum 1 is rotationally driven at a peripheral speed (surface movement speed) of 210 mm/s. Further, in this embodiment, when the image is formed on thick paper (basis weight: 101-200 g/m$^2$), the photosensitive drum 1 is rotationally driven at the peripheral speed of 105 mm/s in the arrow R1 direction. In this embodiment, the peripheral speed of the photosensitive drum 1 corresponds to a process speed of the image forming apparatus 10.

1-2. Charging Means

The charging roller 2 is the charging means for charging the photosensitive drum 1. As shown in FIG. 2, the charging roller 2 is rotatably held by a bearing member (not shown) at each of longitudinal end portions of a core metal 2*a*. The charging roller 2 is urged toward the center of the photosensitive drum 1 by an urging spring 2*e* which is an urging member as an urging means. As a result, the charging roller 2 is press-contacted to the surface of the photosensitive drum 1 with a predetermined urging force and is rotated in an arrow R2 direction (clockwise direction) by the rotation of the develop 1. To the charging roller 2, a charging power source S1 which is a DC voltage source as a charging voltage application means is connected. Further, the photosensitive drum 1 is charged by the charging roller 2 by using the DC charging type.

The photosensitive drum 1 and the charging roller 2 contact each other to form the contact portion a. Here, the contact portion (press-contact portion) a between the photosensitive drum 1 and the charging roller 2 is referred to as the charging nip. With respect to the rotational direction (surface movement direction) of the photosensitive drum 1, upstream of the charging nip a, a distance between the photosensitive drum 1 and the charging roller 2 is gradually narrowed toward the charging nip a. This upstream minute spacing (gap) of the charging nip a with respect to the rotational direction of the photosensitive drum 1 is referred to as an upstream charging gap A1. Further, with respect to the rotational direction of the photosensitive drum 1, downstream of the charging nip a, the distance between the photosensitive drum 1 and the charging roller 2 is gradually widened with a distance from the charging nip a. This downstream minute spacing (gap) of the charging nip a with respect to the rotational direction of the photosensitive drum 1 is referred to as a downstream charging gap A2.

The photosensitive drum 1 is charged in the upstream charging gap A1 and the downstream charging gap A2 with the charging nip a as the center. The charging of the photosensitive drum 1 is effected by electric discharge from the charging roller 2 to the photosensitive drum 1. For that reason, a voltage which is not less than a threshold voltage at which the electric discharge starts is applied to the charging roller 2. In this embodiment, when the voltage of about −600 V or more is applied to the charging roller 2, a surface potential of the photosensitive drum 1 starts to increase. When the applied voltage is increased to not less than about −600 V, the surface potential of the photosensitive drum 1 is increased while keeping a substantially linear relationship with respect to the applied voltage. Then, in this embodiment, when the voltage of −900 V is applied to the charging roller 2, the surface potential of the photosensitive drum 1 is −300 V. Further, when the voltage of −1100 V is applied to the charging roller 2, the surface potential of the develop 1 is −500 V. The above-described threshold voltage (about −600 V) is referred to as a discharge start voltage (charging start voltage) Vth (V). That is, in an image forming process, in order to charge the surface of the photosensitive drum 1 to Vd (V) (dark portion potential) by using the DC charging type, there is a need to apply Vd+Vth (V) to the charging roller 2.

In this embodiment, the voltage of Vd+Vth (V) is applied to the charging roller 2 through the core metal 2*a* by the charging power source S1, so that the surface potential of the photosensitive drum 1 is Vd (V). In this embodiment, the dark portion potential Vd which is the potential when the photosensitive drum 1 is charged by the charging roller 2 was −500 V. For that reason, during the image formation, the DC voltage of −1100 V is applied, as the charging voltage (charging bias), from the charging power source to the charging roller 2.

Here, a width of the charging gap, with respect to the rotational direction of the photosensitive drum 1, in which the charging roller 2 charges the photosensitive drum 1 by the electric discharge varies depending on the voltage applied to the charging roller 2. That is, the charging gap refers to the minute spacing at a portion where the photosensitive drum 1 is charged by generation of the electric discharge but it is known that the minute spacing for permitting the generation of the electric discharge under the voltage application is changed in accordance with the Paschen's law. Incidentally, when the voltage is applied to the charging roller 2 in a state in which the rotation of the photosensitive drum 1 is stopped, the portion where the photosensitive drum 1 is charged corresponds to the charging gap.

In this embodiment, a length of the charging roller 2 with respect to a longitudinal direction (rotational axis direction) is 320 mm. The charging roller 2 has a three-layer structure, on the core metal (supporting member) 2*a* as the center, consisting of a lower layer 2*b*, an intermediate layer 2*c* and a surface layer 2*d* which are laminated in this order. The lower layer 2*b* is a foamed sponge layer for reducing charging noise. The surface layer 2*d* functions as a protective layer for preventing leakage of current even when there is a defect such as a pin-hole on the photosensitive drum 1. In this embodiment, the core metal 2*a* is a round bar formed of stainless steel in a diameter of 6 mm. Further, the lower layer 2*b* is 3.0 mm in thickness and is formed with a foamed EPDM resin material in which carbon black is dispersed. Incidentally, as the foamed EPDM resin material, the resin material of 0.5 g/cm$^3$ in specific gravity and $10^2$-$10^9$ Ωm in volume resistivity was used. The intermediate layer 2*c* is 700 μm in thickness and is formed with an NBR-based rubber in which the carbon black is dispersed. Incidentally, as the NBR-based rubber, the rubber of $10^2$-$10^5$ Ωcm in thickness and is formed with Torejin resin of a fluorine-containing compound. Incidentally, as the Torejin resin, the resin material in which tin oxide and carbon black were dispersed to have a volume resistivity of $10^7$-$10^{10}$ Ωcm was used.

In this embodiment, by the above constitution, the entire volume resistivity of the charging roller 2 was $10^6$ Ωcm in a normal environment (23° C. and 50% RH). As described later specifically, the "charging lateral stripe" is caused by generation of unstable minute electric discharge (separation discharge or the like) in the downstream charging gap A2 without completing the electric discharge in the upstream charging gap A1. For that reason, with a lower electric resistance of the charging roller 2, the electric discharge in the upstream charging gap A1 is liable to be completed, so that the charging lateral stripe is less liable to occur.

Further, in this embodiment, a surface roughness (JIS B 0601: 10-point average surface roughness Rz in 2001 standard) of the charging roller 2 is 5 μm.

1-3. Exposure Means

The exposure device 3 is the exposure means (latent image forming means) for forming the electrostatic latent image on the charged photosensitive drum 1. In this embodiment, the exposure device 3 is a laser beam scanner using a semiconductor laser. The exposure device 3 outputs laser light modulated correspondingly to an image signal inputted from a host processing device (not shown) such as an image reading device. The charged surface of the photosensitive drum 1 is scanned at the exposure portion b with the laser light, so that the electrostatic latent image (electrostatic image) depending on the inputted image signal is formed on the photosensitive drum 1. In this embodiment, a light portion potential (VL) which is a potential at a portion where the photosensitive drum 1 is irradiated with the laser light was −150 V>

1-4. Developing Means

The developing device 4 is the developing means for developing the electrostatic latent image formed on the photosensitive drum 1. In this embodiment, the developing device 4 uses a two-component developer as the developer and develops the electrostatic latent image by a magnetic brush. Further, in this embodiment, a reverse development type is employed, and the toner charged to the same polarity as a charge polarity (negative in this embodiment) of the photosensitive drum 1 is deposited at an exposed portion (light portion) of the surface of the photosensitive drum 1, so that the electrostatic latent image is developed.

The developing device 4 includes a developing container 4*a* and the nonmagnetic developing sleeve 4*b* as a developer carrying member rotatably provided so that a part thereof is exposed to the outside from an opening of the developing container 4*a*. The developing sleeve 4*b* incorporates therein a magnet roller 4*c* as a magnetic field generating means disposed fixedly to the developing container 4*a*. Further, to the developing device 4, a regulating blade 4*d* as a developer regulating member for regulating an amount of the developer carried on the developing sleeve 4*b* is provided opposed to the developing sleeve 4*b*. A developer 4*e*, contained in the developer container 4*a*, in which the toner (nonmagnetic toner particles) and a carrier (magnetic carrier particles) are principally mixed is regulated by the regulating blade 4*d* in a certain thickness and then is carried on the developing sleeve 4*b*. As a result, on the developing sleeve 4*b*, a thin layer of the developer 4*e* is coated.

The developing sleeve 4*b* conveys the toner to the developing portion c by the magnetic brush which is a brush-like erected chain of the carrier formed by the magnetic field generated by the magnet roller 4*c* therein.

The developer 4*e* in the developing container 4*a* is principally a mixture of the toner and the carrier and is fed toward the developing sleeve 4*b* while being uniformly stirred by rotation of two developer stirring members (stirring screws). In this embodiment, the magnetic carrier is about $10^{13}$ Ωm in electric resistance and about 40 μm in particle size. In this embodiment, the toner is triboelectrically charged to the negative polarity by friction with the carrier. Further, a toner content (concentration) of the developer 4*e* in the developing container 4*a* is detected by a content sensor (not shown). Further, on the basis of detection information detected by the content sensor, the toner is supplied from a toner hopper 4*g* into the developing container 4*a* so that the toner content in the developing container 4*a* is kept constant.

The developing sleeve 4*b* keeps the closest distance to the photosensitive drum 1 at 300 μm at the developing portion c, and is provided in proximity to and opposed to the photosensitive drum 1. Further, the developing sleeve 4*b* is rotationally driven so that the surface movement directions of the developing sleeve 4*b* and the photosensitive drum 1 are opposite from each other at the developing portion.

Further, to the developing sleeve 4*b*, a developing power source S2 as a developing voltage application means is connected. During a developing operation, to the developing sleeve 4*b*, a predetermined developing voltage (developing bias) is applied from the developing power source S2. In this embodiment, to the developing sleeve 4*b*, a superimposed developing bias of a DC voltage (Vdc) and an AC voltage (Vac) is applied. Specifically, a frequency of the AC voltage is 8 kHz, the DC voltage is −320 V and a peak-to-peak voltage of the AC voltage is 1800 V.

1-5. Transfer Means

The transfer roller 5 is the transfer means for transferring the toner image formed on the photosensitive drum 1 onto the transfer material (sheet or media) P such as paper which is a transfer-receiving member. The transfer roller 5 contacts the photosensitive drum 1 with a predetermined urging force to form the transfer portion (transfer nip) d. Further, to the transfer roller 5, a transfer power source S3 as a transfer voltage application means is connected. During a transfer operation, to the transfer roller 5, the DC voltage of the positive polarity opposite to the normal charge polarity of the toner is applied, as the transfer voltage (transfer bias), from the transfer power source S3. In this embodiment, the transfer voltage of +500 V is applied to the transfer roller 5. As a result, the transfer image on the photosensitive drum 1 is transferred onto the transfer material P conveyed to the transfer portion d by a conveying means (not shown).

1-6. Cleaning Means

The cleaning device 7 is the cleaning means for removing the toner (transfer residual toner) remaining on the photosensitive drum 1 without being transferred from the photosensitive drum 1 onto the transfer material P. In this embodiment, the cleaning device 7 includes a cleaning blade 7*a* as a cleaning member and a cleaning container 7*b*. The cleaning blade 7*a* is formed with a plate-like electric member and is disposed in contact with the surface of the photosensitive drum 1. The toner residual toner deposited on the photosensitive drum 1 is removed by sliding of the cleaning blade thereon with the rotation of the photosensitive drum 1, thus being collected in the cleaning container 7*b*.

1-7. Fixing Means

The fixing device 6 is a fixing means for fixing the toner image transferred on the transfer material P at the transfer portion d. The fixing device 6 includes a fixing roller 6*a* provided with a heat source and includes a pressing roller 6*b* press-contacted to the fixing roller 6*a*. The fixing roller 6*a* and the pressing roller 6*b* are rotationally driven. The fixing device 6 fixes the toner image, transferred on the transfer material P, on the transfer material P under application of heat and pressure while nip-conveying the transfer material P in the control portion (fixing nip) formed by the fixing roller 6*a* and the pressing roller 6*b*. In this embodiment, depending on a material, a thickness and a basis weight of the transfer material P, a rotational speed of each of the fixing roller 6*a* and the pressing roller 6*b* is controlled by a control circuit 200 (FIG. 2) described later. Specifically, when the image is fixed on the thick paper (basis weight: 101-200 g/m$^2$), these rollers are rotated to provide the process speed of 105 mm/s. Further, when the image is formed on the plain paper (basis weight: 50-100 g/m$^2$), the rollers are rotated to provide the process speed of 210 mm/s.

2. Operating Portion

Next, an operating portion of the image forming apparatus 10 will be described. FIG. 3 shows an operating portion 100 as an operating panel provided to the image forming apparatus 10.

Part (a) of FIG. 3 shows an outer appearance of the operating portion 100. The operating portion 100 includes a start button 101 for executing image formation on the basis of set information by the image forming apparatus 10. Further, the operating portion 100 includes a display (operating screen) 102 of a touch panel type. On the display 102, a screen as shown in (b) of FIG. 3 is displayed. An operator can effect various settings when the image formation is effected by selecting buttons displayed on the display 102. In this embodiment, especially, setting of the type of the transfer material P on which the image is to be formed and a quality priority mode will be described specifically.

As shown in (b) of FIG. 3, on the display 102, a paper type selecting button 103 for setting the type of the transfer material P on which the image is to be formed is displayed. When the paper type selecting button 103 is selected, a screen as shown in (c) of FIG. 3 is displayed on the display 102.

On the screen shown in (c) of FIG. 3, a list of the types of the transfer material P used for the image formation is displayed. The operator can select any of plain paper 104, thick paper 105, coated paper 106 and the like depending on the type of the transfer material P used for the image formation.

As described above, in the case where the plain paper 104 is selected, the process speed is set at 210 mm/s. Further, in the case where the thick paper 105 is selected, the process speed is set at 105 mm/s. Further, the coated paper is the transfer material P which is improved in surface smoothness by subjecting the surface of the transfer material P to coating with a transparent resin material to provide glossiness. Also when the image is formed on the coated paper, similarly as in the case of the thick paper, the process speed is set at 105 mm/s.

Incidentally, the setting of the type of the transfer material P is not limited to the above case where the operator sets the type of the transfer material P but the type of the transfer material P may also be discriminated by using a sensor or the like.

Further, as shown in (b) of FIG. 3, a quality priority mode button 104 for designating a high quality mode is displayed. When this quality priority mode button 104 is selected, even in the case where the image is formed on the plain paper, the process speed is changed to 105 mm/s. By slowing the process speed, it is possible to form the electrostatic latent image on the photosensitive drum 1 with a resolution higher than that in the case where the process speed is fast.

After, the settings of the paper type and the mode are made on the display 102, the start button 101 is pressed, so that the image forming apparatus 10 forms the image depending on the set condition.

Incidentally, a print instruction may also be inputted from an external terminal such as a PC (personal computer).

3. Nip Pre-exposure Device

Next, the nip pre-exposure device 8 as the irradiating means for irradiating the surface of the photosensitive drum 1, corresponding to the upstream charging gap A1, with light in order to suppress the charging lateral stripe will be described.

FIG. 4 shows a schematic control block diagram with respect to the nip pre-exposure device 8 in this embodiment. The nip pre-exposure device 8 irradiates the upstream charging gap A1 with the (hereinafter also referred to as nip pre-exposure). More specifically, in this embodiment, the nip pre-exposure device 8 exposes the surface of the photosensitive drum 1 upstream of the charging nip a with respect to the rotational direction of the photosensitive drum 1, so that electric charges in the image forming area at the exposed portion with respect to the longitudinal direction (rotational axis direction) of the photosensitive drum 1 are removed.

As shown in FIG. 4, the charging roller 2 charges the surface of the photosensitive drum 1 by being supplied with the DC voltage by the charging power source S1. To the nip pre-exposure device 8, a nip pre-exposure power source S4 as an energization means is connected. The nip pre-exposure power source S4 determines whether or not electric power is supplied to the nip pre-exposure device 8 in accordance with control of the control circuit 20 as the control means. The nip pre-exposure device 8 emits the light (ON) when the electric power is supplied and does not emit the light (OFF) when the electric power is not supplied.

In this embodiment, as the nip pre-exposure device 8, an LED (light emitting diode) with a peak wavelength of 660 (±10) nm at room temperature (20° C.) was used. It is known that the wavelength of the light emitted from the LED fluctuates depending on the temperature of a material and applied current. In this embodiment, the LED having a formal direction drop voltage of 1.4 V, a maximum rated output of 3 mV, a maximum operating current of 95 mA, a maximum output of 2.1 mW and a luminous efficiency of 39 lm/W was used. In this embodiment, a light quantity of the nip pre-exposure device 8 was 8 (lx·s).

Incidentally, the upstream charging gap A1 is a slight area in which the electric discharge is effected between the charging roller 2 and the photosensitive drum 1. In this embodiment, the upstream charging gap A1 was the area from an upstream end of the charging nip a until a position 1 mm distant from the upstream end with respect to the rotational direction of the photosensitive drum 1. Similarly, the downstream charging gap A2 was the area from a downstream end of the charging nip a until a position 1 mm distant from the downstream end with respect to the rotational direction of the photosensitive drum 1.

The control circuit 200 includes the CPU as a computing control means and includes ROM, RAM and the like as a storing means, and controls the respective portions of the image forming apparatus 10 depending on the image forming signal inputted from the operating portion 100 or the external terminal such as the PC. For example, the control circuit 200 obtains information of the transfer material P designated by the operating portion 100 and determines the process speed depending on the information. Further, an image forming condition of the image forming portion is controlled depending on the process speed. More specifically, the control circuit 200 is capable of controlling whether or not the electric power is supplied to the nip pre-exposure device 8 by the nip pre-exposure power source S4. Depending on the electric power supplied from the nip pre-exposure power source S4, the nip pre-exposure device 8 can output the light at 8 (lx·s) per unit time.

Incidentally, the light quantity was measured by using an illuminometer in accordance with JIS C 1609-1 (Class: A4, revised in 2006). The illuminometer measures the light quantity in a visible light region (420-700 nm). For that reason, in order to detect a change of the light quantity in a region other than the visible light region, e.g., a photodiode may also be used. In order to detect a change of the light quantity at a waveform where the surface electric charges of the photosensitive drum 1 can be removed, it is preferable that the light passing through an optical filter for cutting a waveform at which the sensitivity of the photosensitive drum 1 is low is detected by the photodiode.

4. Mechanism of Occurrence of Charging Lateral Stripe with Change of Process Speed Next, a problem of the charging lateral stripe which can occur, irrespective of the process speed, in the case where the light quantity of the nip pre-exposure device 8 is constant will be described.

Parts (a) to (d) of FIG. 11 are schematic views for illustrating the mechanism of the occurrence of the charging lateral stripe and its suppressing effect by the nip pre-exposure. Particularly, (a) of FIG. 11 schematically illustrates the electric process speed in the charging gap in the case where the nip pre-exposure is not effected when the process speed (PS) is 210 mm/s (first speed). Part (b) of FIG. 11 schematically illustrates the electric discharge in the charging gap in the case where the upstream charging gap A1 is exposed to light with the light quantity of 8 (lx·s) by the nip pre-exposure device 8 when the process speed is 210 mm/s (first speed). Further, (c) of FIG. 11 schematically illustrates the electric process speed in the charging gap in the case where the nip pre-exposure is not effected when the process speed (PS) is 105 mm/s (second speed). Part (d) of FIG. 11 schematically illustrates the electric discharge in the charging gap in the case where the upstream charging gap A1 is exposed to light with the light quantity of 8 (lx·s) by the nip pre-exposure device 8 when the process speed is 105 mm/s (second speed).

First, the case where the nip pre-exposure is not effected will be described.

As shown in (a) of FIG. 11, the charging roller 2 is codirectionally rotated with respect to the rotating photosensitive drum 1, thus charging the photosensitive drum 1. In the upstream charging gap A1, when the potential difference between the photosensitive drum 1 and the charging roller 2 exceeds the threshold (based on the Paschen's law) of the start of electric discharge, the electric discharge is effected and thus the photosensitive drum 1 is charged to the charge potential (Vd). However, e.g., when the electric resistance at a part of the charging roller 2 is increased, there is the case where the charging is not uniformly completed in the upstream charging gap A1. In that case, in the downstream charging gap A2, unstable minute electric discharge (separation discharge or the like) occurs and therefore the charging lateral stripe can be generated.

On the other hand, in the case where the process speed is 105 mm/s slower than that (the process speed of 210 mm/s) in the case of (a) of FIG. 11, the charging time in the upstream charging gap A1 is sufficiently long. For this reason, the uniform charging is completed in the upstream charging gap A1 and thus the unstable minute electric discharge (separation discharge or the like) little occurs. Therefore, the charging lateral stripe is not generated.

Next, the case where the nip pre-exposure is effected in the upstream charging gap A1 will be described.

As shown in (b) of FIG. 11, in the upstream charging gap AS1, the charged photosensitive drum 1 is charge-removed by the light L from the nip pre-exposure device 8. For that reason, the photosensitive drum 1 is principally charged in the downstream charging gap A2. As a result, the unstable minute electric discharge (separation discharge or the like) in the downstream charging gap A2 is not readily generated, so that the charging lateral stripe can be suppressed.

On the other hand, (d) of FIG. 11 shows the case where when the process speed is 105 mm/s slower than that (the process speed of 210 mm/s) of the case of (c) of FIG. 11, the photosensitive drum 1 is charge-removed by exposing the upstream charging gap A1 with the same light quantity as in the case of (c) of FIG. 11. In this case, even when the upstream A1 is exposed, the photosensitive drum 1 is sufficiently charged in the upstream charging gap A1 to the extent such that thereafter the unstable minute electric discharge (separation discharge or the like) can occur in the downstream charging gap A2. That is, in this case, even when the nip pre-exposure is effected, the photosensitive drum 1 is charged in the upstream charging gap A1 and therefore the minute electric discharge (separation discharge or the like) generated in the downstream charging gap A2 cannot be suppressed sufficiently.

Further, in the DC charging type, there is the case where the lateral stripe on the image generated by the electric discharge once occurred in the upstream charging gap A1 and then once again occurred in the downstream charging gap A2, i.e., the charging lateral stripe is generated. Therefore, the photosensitive drum 1 is charge-removed by irradiating the upstream charging gap A1 with the light by the nip pre-exposure device 8 to be charged uniformly in the downstream charging gap A2, so that the charging lateral stripe can be suppressed. That is, in this method using the nip pre-exposure device 8, the action of the charging by the charging roller 2 is localized in the downstream charging gap A2, so that the charging lateral stripe is suppressed. However, even in the case where the nip pre-exposure device 8 is used, a balance of repetition of the charge removal and the charging in the upstream charging gap A1 is changed depending on the process speed, i.e., the surface movement speed of the photosensitive drum 1. That is, when the process speed is slow, with respect to the charge removal in the upstream charging gap A1, an amount of re-charging is increased. For that reason, the charging cannot be completely localized in the downstream charging gap A2 and thus the unstable minute electric discharge is liable to occur in the downstream charging gap A2, so that the charging lateral stripe cannot be suppressed sufficiently.

As described above, in this embodiment, in the case where the image is formed on the thick paper, the process speed is made slower than that in the case where the image is formed on the plain paper. Accordingly, in other words, in this embodiment, in the case where the image is formed on the thick paper, when the nip pre-exposure is effected with the same light quantity as that in the case where the image is formed on the plain paper, there is the case where a lateral stripe-like image defect resulting from the charging lateral stripe is generated on a print to be outputted.

Therefore, in this embodiment, as described later in detail, the image forming apparatus 10 controls the irradiation of the upstream charging gap A1 with the light by the nip pre-exposure device 8 so as to be adjusted depending on the process speed.

5. Process Speed and Nip Pre-Exposure Amount

The control circuit 200 changes the process speed on the basis of the information on the type of the transfer material P or the like set in the operating portion 100. As described above, when the upstream charging gap A1 is exposed to the light at a certain light quantity by the nip pre-exposure device 8 irrespective of the process speed, the charging lateral stripe is generated. Therefore, every different process speed, the light quantity of the light with which the upstream charging gap A1 is irradiated by the nip pre-exposure device 8 (hereinafter also referred to as a nip pre-exposure amount) is changed. Then, the image defect attributable to the charging lateral stripe generated at that time on the print to be outputted was evaluated. In this embodiment, an experiment was conducted in a low temperature/low humidity environment (15° C./10% RH) in which the electric resistance of the charging roller 2 was increased and thus the charging lateral stripe was liable to occur.

Table 1 shows a summary the evaluation of the image on the print to be outputted when the nip pre-exposure amount is changed in each of the cases of the process speed of 210 mm/s (first speed) and the process speed of 105 mm/s (second speed).

TABLE 1

| PS*[1] | Exposure amount (1x · s) | | | | | | | | |
|---|---|---|---|---|---|---|---|---|---|
| (mm/s) | 0 | 2 | 4 | 6 | 8 | 10 | 12 | 14 | 16 |
| 105 | ◎ | X | X | X | X | X | Δ | ○ | ◎ |
| 210 | X | X | Δ | ○ | ◎ | ◎ | ◎ | ◎ | ◎ |

*[1]"PS" represents the process speed (mm/s)

The charging lateral stripe appears in a stripe (streak)-shape with respect to a direction parallel to the longitudinal direction (rotational axis direction) of the charging roller 2 and appears conspicuously when a halftone image is formed. Therefore, as the print, the transfer material P on which the halftone image (125 level of 256 gradation levels) was formed at its whole surface was used. In Table 1, with respect to the image on the outputted print, the case where the image is good is represented by "◎", the case where the image is fair is represented by "○", the case where there is density non-uniformity on the image is represented by "Δ", and the case where there is the density non-uniformity or roughness due to density change on the image is represented by "x".

From Table 1, in the case where the process speed is slow, i.e., 105 mm/s, it is understood that the charging lateral stripe is not generated even when the nip pre-exposure is not effected. Further, in the case of the process speed of 10 5 mm/s, in order to suppress the charging lateral stripe by localizing the electric discharge in the downstream charging gap A2 through the nip pre-exposure, it is understood that the nip pre-exposure amount is required to be made larger than a value thereof required when the process speed is 210 mm/s.

6. Nip Pre-Exposure Amount and Abrasion Amount

Next, a relationship between the nip pre-exposure amount and an abrasion amount of the photosensitive drum 1 will be described.

Part (a) of FIG. 5 shows a relationship between the nip pre-exposure amount and the DC current flowing between the photosensitive drum 1 and the charging roller 2. Further, (b) of FIG. 5 shows a relationship between the nip pre-exposure amount and the abrasion amount of the photosensitive drum 1 when a whole-area solid white image (0 level of 256 gradation levels) is outputted on 10,000 (10K) sheets of A4-sized paper. Specifically, the results shown in (a) and (b) of FIG. 5 are those obtained by measuring the DC current value by using an ammeter disposed between the photosensitive drum 1 and the ground when a durability test for forming the solid white image at the process speed of 210 mm/s and the charge potential (Vd) of −500 V.

As is understood from (a) and (b) of FIG. 5, when the nip pre-exposure amount is increased, the abrasion amount of the photosensitive drum 1 is increased. This is because when the nip pre-exposure amount is increased, the amount of charge removal in the upstream charging gap A1 is increased and therefore an amount of re-electric discharge for re-charging the photosensitive drum 1 from the charging roller 2 is increased.

As shown in Table 1, in the case where the process speed is slow (105 mm/s), in order to suppress the charging lateral stripe by the nip pre-exposure, the nip pre-exposure amount is required to be 16 (lx·s) larger than that in the case where the process speed is fast (210 mm/s). Further, in this way, when the nip pre-exposure amount is increased, the abrasion amount is increased as described above and therefore the lifetime of the photosensitive drum 1 tends to be shortened.

For that reason, the irradiation of the upstream charging gap A1 with the light by the nip pre-exposure device 8 may desirably be adjusted depending on the process speed so as to suppress the charging lateral stripe and at the same time so as to prevent the lifetime of the photosensitive drum 1 from being shortened.

7. Operation of Nip Pre-exposure Device

Next, a flow of the operation of the image forming apparatus 10 in this embodiment will be described more specifically. In this embodiment, the image forming apparatus 10 performs an operation for turning on ("ON") and off ("OFF") the nip pre-exposure depending on the process speed.

FIG. 6 shows a summary of the flow of the operation of the image forming apparatus 10 in this embodiment. The CPU provided inside the control circuit 200 controls the image forming apparatus 10 so as to be operated along a flow chart of FIG. 6 in accordance with a program stored in the ROM provided inside the control circuit 200.

In this embodiment, an example in which the image forming condition is changed depending on the type of the transfer material P on which the image is to be formed will be described. Incidentally, the operator has designated the type of the transfer material P, on which the image is to be formed, by the operating portion 100.

S101 is a step in which the control circuit 200 obtains the type of the transfer material P on which the image is to be formed. The control circuit 200 obtains the type of the transfer material P set in the operating portion 100.

S102 is a step in which the control circuit 200 judges whether the type of the transfer material P, on which the image is to be formed, obtained in S101 is the plain paper or the thick paper, and then changes processing depending on a result of the judgment. The control circuit 200 executes the processing of S103 in the case where the type of the transfer material P is the plain paper. On the other hand, the control circuit 200 executes the processing of S104 in the case where the type of the transfer material P is the thick paper.

S103 is a step in which the image forming condition in the case where the image is formed on the plain paper is set. The control circuit 200 sets the process speed at 210 mm/s and the nip pre-exposure amount at 8 (lx·s) (image form light quantity) when the image is formed on the plain paper.

S104 is a step in which the image forming condition in the case where the image is formed on the thick paper is set. The control circuit 200 sets the process speed at 105 mm/s and the nip pre-exposure at "OFF" when the image is formed on the thick paper.

S105 is a step in which the control circuit 200 controls the image forming apparatus 10 in accordance with the image forming condition set in S103 or S104. In this embodiment, specifically, the control circuit 200 rotationally drives the photosensitive drum 1 and the like so that a set process speed is obtained during the image formation for forming the image on the transfer material P. Further, the control circuit 200 effects control so that a predetermined charge voltage is applied to the charging roller 2 and so that the light irradiation is effected at a predetermined light quantity by the nip pre-exposure device 8 or is turned off.

Thus, in this embodiment, during the image formation, the control circuit 200 changes the operation of the nip pre-exposure device 8 depending on the process speed. In this embodiment, the nip pre-exposure is effected at the predetermined light quantity in the case where the process speed is the first speed and is not effected ("OFF") in the case where the process speed is the second speed slower than the first speed. As a result, it is possible to suppress the generation of the charging lateral stripe, occurring when the photosensitive drum 1 is charged by the charging roller 2, while realizing lifetime extension of the photosensitive drum 1. That is, even when the process speed is changed depending on the type of the transfer material P on which the image is formed, while realizing the lifetime extension of the photosensitive drum 1, it is possible to suppress the occurrence of the image defect resulting from the charging lateral stripe.

Incidentally, the nip pre-exposure device 8 may preferably expose a portion of the photosensitive drum 1, on which the electrostatic latent image corresponding to the image to be formed on the transfer material P, when the portion of the photosensitive drum 1 is charged.

Further, in this embodiment, ON/OFF of the light with which the upstream charging gap A1 is irradiated by the nip pre-exposure device 8 was changed by ON/OFF of the electric power supplied to the nip pre-exposure device 8 by the nip pre-exposure power source S4. However, the present invention is not limited thereto. For example, a shutter is provided between the nip pre-exposure device 8 and the upstream charging gap A1 and then the light from the nip pre-exposure device 8 is blocked by the shutter to perform the OFF operation.

(Embodiment 2)

Next, another embodiment of the present invention will be described. In this embodiment, basis constitution and operation of the image forming apparatus are the same as those in Embodiment 1. Therefore, elements having the same or corresponding functions and constitutions as those in Embodiment 1 are represented by the same reference numerals or symbols and will be omitted from detailed description.

FIG. 7 shows a relationship between the charge voltage (charging bias) applied from the charging power source S1 to the charging roller 2 and the charge potential (surface potential) of the photosensitive drum 1 measured at the developing portion c in each of the case where the nip pre-exposure is not effected and the case where the nip pre-exposure is effected. Incidentally, the nip pre-exposure amount in the case where the nip pre-exposure is effected was 8 (lx·s).

In Embodiment 1, the constitution in which the nip pre-exposure was not effected in the case where the process speed was 105 mm/s but was effected in the case where the process speed was 210 mm/s was employed. However, in this constitution, as shown in FIG. 7, deviation (shift) of the charge potential of the photosensitive drum 1 at the developing portion c can occur.

As shown in FIG. 7, in a range of all the charge voltage values, the deviation of the potential between the case of (1) in which the process speed is 105 mm/s and the nip pre-exposure is not effected and the case (3) in which the process speed is 210 mm/s and the nip pre-exposure is effected was about 20 V.

This potential deviation is a result of a lowering of the charge potential (a decrease of charge amount) with time in a period from after a portion of the photosensitive drum 1 is charged at the charging portion (charging nip a and the charging gaps A1 and A2) until the portion of the photosensitive drum 1 reaches the developing portion c, and is attributable to a so-called "dark decay" phenomenon.

It is known that the amount of the above dark decay is small when the movement speed of the photosensitive drum 1 is fast, and is large when a photo-carrier remains in the photosensitive drum 1 by the pre-exposure or the like.

As shown in FIG. 7, in comparison between the case of (1) in which the process speed is 105 mm/s and the nip pre-exposure is not effected and the case of (2) in which the process speed is 210 mm/s and the nip pre-exposure is not effected, an absolute value of the charge potential at the developing portion c is 5 V higher in the case of (2). This is caused due to the speed difference. Further, as shown in FIG. 7, in comparison between the case of (2) in which the process speed is 210 mm/s and the nip pre-exposure is not effected and the case of (3) in which the process speed is 210 mm/s and the nip pre-exposure is effected, an absolute value of the charge potential at the developing portion c is 25 V higher in the case of (2). This is caused due to the difference between the case where the nip pre-exposure is effected and the case where the nip pre-exposure is not effected.

Therefore, in comparison between the case of (1) in which the process speed is 105 mm/s and the nip pre-exposure is not effected and the case of (3) in which the process speed is 210 mm/s and the nip pre-exposure is effected, an absolute value of the charge potential at the developing portion c is 20 V lower in the case of (3). For that reason, in the constitution in Embodiment 1, due to this deviation in charge potential, there is the case where a difference in image density is caused between the case where the image is formed on the plain paper and the case where the image is formed on the thick paper. This is attributable to an increase of the image density with a decrease of the charge potential when the charging bias is the same and the light portion potential VL is the same. That is, compared with the case where the image is formed on the plain paper, in the case where the image is formed on the thick paper, the phenomenon that the image density is increased can occur.

Therefore, in this embodiment, as described below in detail, control is effected so that the image density difference between the case where the light irradiation is effected by the nip pre-exposure device 8 and the case where the light irradiation is not effected ("OFF") is corrected.

Next, a flow of the operation of the image forming apparatus 10 in this embodiment will be described more specifically. In this embodiment, the image forming apparatus 10 performs an operation for turning on ("ON") and off ("OFF") the nip pre-exposure depending on the process speed. Further, in this embodiment, the image forming apparatus 10 performs an operation for charging the charge voltage applied to the charging roller 2 depending on ON/OFF of the nip pre-exposure.

In this embodiment, the control circuit 200 has the function of an adjusting means for adjusting the DC voltage applied from the charging power source S1 to the charging roller 2 depending on whether or not the light irradiation by the nip pre-exposure device 8 is effected. Further, in this embodiment, this adjusting means adjusts, irrespective of whether or not the light irradiation by the nip pre-exposure device 8 is effected, the DC voltage applied to the charging roller 2 so that the charge potential after the photosensitive drum 1 charged by the charging roller 2 is moved by the predetermined distance is the same.

FIG. 8 shows a summary of the flow of the operation of the image forming apparatus 10 in this embodiment. The CPU provided inside the control circuit 200 controls the image forming apparatus 10 so as to be operated along a flow chart of FIG. 8 in accordance with a program stored in the ROM provided inside the control circuit 200.

In this embodiment, an example in which the image forming condition is changed depending on the type of the transfer material P on which the image is to be formed will be described. Incidentally, the operator has designated the type of the transfer material P, on which the image is to be formed, by the operating portion 100.

S201 is a step in which the control circuit 200 obtains the type of the transfer material P on which the image is to be formed. The control circuit 200 obtains the type of the transfer material P set in the operating portion 100.

S202 is a step in which the control circuit 200 judges whether the type of the transfer material P, on which the image is to be formed, obtained in S201 is the plain paper or the thick paper, and then changes processing depending on a result of the judgment. The control circuit 200 executes the processing of S203 in the case where the type of the transfer material P is the plain paper. On the other hand, the control circuit 200 executes the processing of S204 in the case where the type of the transfer material P is the thick paper.

S203 is a step in which the image forming condition in the case where the image is formed on the plain paper is set. The control circuit 200 sets the process speed at 210 mm/s and the nip pre-exposure amount at 8 (lx·s) (image form light quantity) when the image is formed on the plain paper. Further, the control circuit 200 sets, when the image is formed on the plain paper, the charge voltage applied to the charging roller 2 so as to offset −20 V corresponding to the deviated potential at the developing portion c. In this embodiment, in order to set the charge potential of the photosensitive drum 1 at the developing portion c at −500 V, the control circuit 200 effects the control so that the DC voltage of −1120 V is applied to the charging roller 2.

S204 is a step in which the image forming condition in the case where the image is formed on the thick paper is set. The control circuit 200 sets the process speed at 105 mm/s and the nip pre-exposure at "OFF" when the image is formed on the thick paper. Further, the control circuit 200 effects, when the image is formed on the thick paper, control so that the DC voltage of −1100 V is applied to the charging roller 2 in order to set the charge potential of the photosensitive drum 1 at the developing portion c at −500 V.

S205 is a step in which the control circuit 200 controls the image forming apparatus 10 in accordance with the image forming condition set in S203 or S204. In this embodiment, specifically, the control circuit 200 rotationally drives the photosensitive drum 1 and the like so that a set process speed is obtained during the image formation for forming the image on the transfer material P. Further, the control circuit 200 effects control so that a predetermined charge voltage is applied to the charging roller 2 and so that the light irradiation is effected at a predetermined light quantity by the nip pre-exposure device 8 or is turned off.

Thus, in this embodiment, during the image formation, the control circuit 200 changes the operation of the nip pre-exposure device 8 depending on the process speed. In this embodiment, the nip pre-exposure is effected at the predetermined light quantity in the case where the process speed is the first speed and is not effected ("OFF") in the case where the process speed is the second speed slower than the first speed. As a result, it is possible to suppress the generation of the charging lateral stripe, occurring when the photosensitive drum 1 is charged by the charging roller 2, while realizing lifetime extension of the photosensitive drum 1. Further, the deviation in charge potential of the photosensitive drum 1 between the case where the nip pre-exposure is effected and the case where the nip pre-exposure is not effected is corrected by correcting the charge voltage. As a result, it is also possible to correct the deviation of the image density due to the change of the process speed. That is, even when the process speed is changed depending on the type of the transfer material P on which the image is formed, while realizing the lifetime extension of the photosensitive drum 1, it is possible to suppress the occurrence of the image defect resulting from the charging lateral stripe.

Incidentally, in this embodiment, the deviation in charge potential of the photosensitive drum 1 was adjusted by the correction of the charge voltage. However, the image forming condition corrected for correcting the image density deviation on the image is not limited to the charge voltage. For example, as the image forming condition, it is also possible to correct the image density deviation by correcting the light portion potential VL by laser power of the exposure device 3 or by correcting the developing bias of the developing device 4. However, as described above, the deviation in charge potential of the photosensitive drum 1 is caused due to the dark decay and therefore the correction of the charge voltage is simple and preferable. Further, in this embodiment, the correction of the image forming condition such as the charge voltage made in the case of effecting the nip pre-exposure in order to correct the deviation in charge potential at the developing portion c in the case of effecting the nip pre-exposure relative to the case where the nip pre-exposure is not effected was described. However, in order to correct the deviation in charge potential at the developing portion c in the case where the nip pre-exposure is not effected relative to the case of effecting the nip pre-exposure, the image forming condition such as the charge voltage may also be corrected in the case where the nip pre-exposure is not effected.

(Embodiment 3)

Next, another embodiment of the present invention will be described. In this embodiment, basis constitution and operation of the image forming apparatus are the same as those in Embodiment 1. Therefore, elements having the same or corresponding functions and constitutions as those in Embodiment 1 are represented by the same reference numerals or symbols and will be omitted from detailed description.

Table 2 shows a relationship between the temperature in the image forming apparatus 10 and a level of the occurrence of the charging lateral stripe in the case where the process speed is 210 mm/s and the nip pre-exposure is not effected. An evaluation method and an evaluation criterion are the same as those in the experiment by which the result of Table in Embodiment 1 is obtained.

TABLE 2

| TEMPERATURE (° C.) | Level |
|---|---|
| 15 | X |
| 20 | X |
| 25 | X |
| 30 | Δ |
| 35 | ○ |
| 40 | ◎ |

From Table 2, it is understood that there is tendency that the charging lateral stripe is not readily generated, in the setting in which the nip pre-exposure is not effected, with an increase of the temperature in the image forming apparatus 10 even in the case where the process speed is 210 mm/s at which the charging lateral stripe is liable to occur. It was found, as a result of study by the present inventor, that this tendency is shown for the following reason. That is because when a condition in which the temperature in the image forming apparatus 10 is increased and thus the electric resistance of the charging roller 2 is lowered is formed, the electric discharge in the upstream charging gap A1 is tending to be completed and thus the unstable minute electric discharge (separation discharge or the like) is not readily generated in the downstream charging gap A2.

Therefore, in this embodiment, the temperature in the image forming apparatus 10 is detected and in the case where a detection result is not less than a predetermined value, even when the process speed is 210 mm/s, control is effected so that the nip pre-exposure is not effected. In this embodiment, from the result of Table 2, the predetermined value was 35° C.

FIG. 9 is a schematic control block diagram relating to the nip pre-exposure device 8 in this embodiment. As shown in FIG. 9, the schematic control block in this embodiment is similar to that shown in FIG. 4 but in this embodiment, the image forming apparatus 10 is provided with an environment sensor 300, as an environment detecting means, for measuring the temperature in the image forming apparatus 10. Information on the temperature measured by the environment sensor 300 is transmitted to the control circuit 200.

Next, a flow of the operation of the image forming apparatus 10 in this embodiment will be described more specifically. In this embodiment, the image forming apparatus 10 performs an operation for turning on ("ON") and off ("OFF") the nip pre-exposure depending on the process speed. Further, in this embodiment, the image forming apparatus 10 performs the operation for turning on and off the nip pre-exposure depending on the temperature information in the image forming apparatus 10.

FIG. 10 shows a summary of the flow of the operation of the image forming apparatus 10 in this embodiment. The CPU provided inside the control circuit 200 controls the image forming apparatus 10 so as to be operated along a flow chart of FIG. 10 in accordance with a program stored in the ROM provided inside the control circuit 200.

In this embodiment, an example in which the image forming condition is changed depending on the type of the transfer material P on which the image is to be formed will be described. Incidentally, the operator has designated the type of the transfer material P, on which the image is to be formed, by the operating portion 100.

S301 is a step in which the control circuit 200 obtains the type of the transfer material P on which the image is to be formed. The control circuit 200 obtains the type of the transfer material P set in the operating portion 100.

S302 is a step in which the control circuit 200 judges whether the type of the transfer material P, on which the image is to be formed, obtained in S301 is the plain paper or the thick paper, and then changes processing depending on a result of the judgment. The control circuit 200 executes the processing of S303 in the case where the type of the transfer material P is the plain paper. On the other hand, the control circuit 200 executes the processing of S304 in the case where the type of the transfer material P is the thick paper.

S303 is a step in which the process speed as one of the image forming conditions in the case where the image is formed on the plain paper is set. The control circuit 200 sets the process speed at 210 mm/s when the image is formed on the plain paper.

S305 is a step in which the control (control circuit means) 200 obtains, after the process speed is set at 210 mm/s in S303, information on the temperature in the image forming apparatus 10. The control circuit 200 obtains the information on the temperature in the image forming apparatus 10 by the environment sensor 300.

S306 is a step in which the control circuit 200 judges whether or not the temperature in the image forming apparatus 10 obtained in S305 is less than 35° C. and then changes processing depending on a result of the judgment. The control circuit 200 executes the processing of S307 when the temperature is less than 35° C. On the other hand, the control circuit 200 executes the processing of S308 when the temperature is not less than 35° C.

S307 is a step in which the ON/OFF of the nip pre-exposure as one of the image forming conditions in the case where the image is formed on the photosensitive drum and in the case where the temperature in the image forming apparatus 10 is less than 35° C. is controlled. The control circuit 200 sets, in these cases, the nip pre-exposure amount at 8 (lx·s) .

S308 is a step in which the ON/OFF of the nip pre-exposure as one of the image forming conditions in the case where the image is formed on the photosensitive drum and in the case where the temperature in the image forming apparatus 10 is not less than 35° C. is controlled. The control circuit 200 sets, in these cases, the nip pre-exposure so as to be turned off ("OFF").

On the other hand, S304 is a step in which the image forming condition in the case where the image is formed on the thick paper is set. The control circuit 200 sets the process speed at 105 mm/s and the nip pre-exposure at "OFF" when the image is formed on the thick paper.

S409 is a step in which the control circuit 200 controls the image forming apparatus 10 in accordance with the image forming condition set in S303, S304, S307 or S308. In this embodiment, specifically, the control circuit 200 rotationally drives the photosensitive drum 1 and the like so that a set process speed is obtained during the image formation for forming the image on the transfer material P. Further, the control circuit 200 effects control so that a predetermined charge voltage is applied to the charging roller 2 and so that the light irradiation is effected at a predetermined light quantity by the nip pre-exposure device 8 or is turned off.

Thus, in this embodiment, during the image formation, the control circuit 200 changes the operation of the nip pre-exposure device 8 depending on the process speed. In this embodiment, the nip pre-exposure is effected at the predetermined light quantity in the case where the process speed is the first speed and is not effected ("OFF") in the case where the process speed is the second speed slower than the first speed. Further, also in the case where the process speed is the first speed which is fast, the nip pre-exposure is not effected ("OFF").

Thus, by changing the threshold of the process speed for turning on and off the nip pre-exposure depending on the environment, the light irradiation by the nip pre-exposure device 8 can be turned on ("ON") only in a status in which the charging lateral stripe is generated. That is, in this embodiment, the process speed of 210 mm/s corresponds to the threshold of the process speed for turning on and off the nip pre-exposure. Then, depending on the environment, the process speed as the threshold is changed to a higher speed, so that the nip pre-exposure is turned off even in the case where the process speed is 210 mm/s. As the process speed, in the case where first, second and third speeds are provided and are a higher speed in this order, depending on the environment, the threshold for turning on and off the nip pre-exposure can be changed, e.g., from the second speed to the third speed. As a result, e.g., in the case where the temperature is less than a predetermined value, the nip pre-exposure is turned on at the second speed or the third speed, and in the case where the temperature is not less than the predetermined value, the nip pre-exposure can be turned on only at the third speed.

As described in Embodiment 1, when the nip pre-exposure amount is increased, the abrasion amount of the photosensitive drum 1 is increased. For that reason, the turning-on of the light irradiation by the nip pre-exposure device 8 only in the status in which the charging lateral stripe is generated is advantageous in terms of reduction of the abrasion amount of the photosensitive drum 1. Therefore, according to this embodiment, it is possible to suppress the generation of the charging lateral stripe, occurring when the photosensitive drum 1 is charged by the charging roller 2, while realizing further lifetime extension of the photosensitive drum 1. That is, even when the process speed is changed depending on the type of the transfer material P on which the image is formed, while realizing further lifetime extension of the photosensitive drum 1, it is possible to suppress the occurrence of the image defect resulting from the charging lateral stripe.

Incidentally, in this embodiment, the example in which the environment sensor obtains the temperature information is described but the present invention is not limited thereto. The environment sensor may also be used for measuring a relative humidity or an absolute water content in addition to the temperature, so that these measurement results can be fed back to the ON/OFF of the nip pre-exposure. As described above, by the lowering in electric resistance of the charging roller, the electric discharge in the upstream charging gap is easily completed. Therefore, in the case where the relative humidity or absolute water content in the image forming apparatus 10 is measured, an increase of these values generally corresponds to the lowering in electric resistance of the charging roller. Therefore, the nip pre-exposure is turned off in the case where the temperature is not less than the predetermined value in the above embodiment and instead thereof, in the case where the relative humidity or absolute water content is not less than the predetermined value, the nip pre-exposure can be turned off.

That is, the environment detecting means may also be used for measuring the information on the temperature and/or humidity (temperature, humidity or both of these). Specifically, the image forming apparatus may include the environment detecting means for measuring the temperature and or humidity in the image forming apparatus. Further, the control circuit 200 effects, in the case where the measurement result of the temperature and/or humidity in the image forming apparatus is not less than the predetermined value, control so that the nip pre-exposure is not effected even in the case where the photosensitive drum 1 is moved at the first speed at which the nip pre-exposure is effected when the measurement result is less than the predetermined value.

(Other Embodiments)

In the above, the present invention is described based on the specific embodiments but is not limited thereto.

For example, in the above-described embodiments, the case where the number of the type of the transfer material on which the image is formed is two (types) consisting of the plain paper and the thick paper was described as the example. However, in the transfer materials of other materials such as other paper types (coated paper, thin paper), OHP sheet and the like, in the case where the process speed is changed, a problem similar to the described above can arise. Incidentally, the image forming apparatus forms the image at a predetermined process speed depending on the type of the transfer material P. Therefore, also in the case where these other transfer materials are used, the present invention can be equivalently applied, so that an effect similar to that described above can be obtained.

Further, in the above-described embodiments, the case where the process speed is changed depending on the type of the transfer material is described as the example but there is the case where the process speed is changed even in the case of the use of the same type of the transfer material as in the image (quality) priority mode. Also in such a case, there can arise a problem similar to that described above in the case where the process speed is change. Therefore, also in such a case, an effect similar to that described above can be obtained by effecting the control depending on the process speed similarly as in the above-described embodiments.

Further, the process speed is not limited to the case where the process speed is changed at two levels. Even in the case where the process speed is changed to three or more levels, the present invention is applicable. That is, in the case where the image is formed at a slower speed, when the nip pre-exposure is effected at the same light quantity as that in the case where the image is formed at a faster (another) speed, there is the case where the stripe-like image defect attributable to the charging lateral stripe is generated. In that case, with respect to these process speeds, the nip pre-exposure control similar to that in the above-described embodiments can be effected, so that an effect similar to that in the above-described embodiments can be obtained.

Further, in the embodiments described above, the LED is employed as the nip pre-exposure device and the pre-exposure device but the present invention is not limited thereto. Another exposure device such as a light irradiation device is using a fuse lamp may also be used. Further, the light exposure may also be effected in the upstream charging gap from the inside of a transparent photosensitive member.

Further, in the embodiments described above, the charging roller as a flexible charging member was described as the sample. However, the present invention is similarly applicable when the distance between the photosensitive member and the charging member in the upstream charging gap is gradually decreased with the position close to the contact portion with respect to the photosensitive member movement direction and is gradually increased with the position distant from the contact portion with respect to the photosensitive member movement direction. In such a case, even when the distance between the charging member and the photosensitive member is linearly decreased (or increased) or non-linearly decreased (or increased), an effect similar to that in the above-described embodiments can be expected. For example, as the charging member, an electroconductive belt 21 ((a) of FIG. 12), an electroconductive rubber blade 22 ((b) of FIG. 12) for charging the photosensitive member in contact with the photosensitive member at an edge portion, and the like member may also be used.

Further, in the embodiments described above, the charging roller as the charging member and the photosensitive drum as the photosensitive member are contacted but a minute gap may also be formed. In such a constitution, the distance between the photosensitive drum and the charging roller is, with respect to the rotational direction of the photosensitive drum, gradually decreased toward the closest position (the closest portion) between the charging roller and the photosensitive drum and is gradually increased with the position distant from the closest position.

Further, in the above-described embodiments, the rotatable drum-like photosensitive member is used but as the photosensitive member, a movable belt-like photosensitive belt may also be used. In this case, the upstream and downstream with respect to the photosensitive drum rotational direction and those with respect to the photosensitive belt movement direction correspond to each other, respectively.

Further, in the above-described embodiments, in order to suppress the charging lateral stripe appearing on the image, in the upstream charging gap, the longitudinal image forming area of the photosensitive drum was exposed to light by the nip pre-exposure. However, the whole longitudinal area of the photosensitive drum may also be exposed to light. As a result, in the apparatus in which the image is formed on the small-sized transfer material and the large-sized transfer material, when the image is continuously formed on the small-sized transfer material, it is possible to suppress an occurrence of non-uniformity of the abrasion amount of the photosensitive drum with respect to the longitudinal direction.

Further, by using an available media sensor, the size and type of the transfer material on which the image is to be formed may also be specified.

Further, the present invention is also similarly applicable to an image forming apparatus having a so-called cleaner-less constitution in which the cleaning is effected simultaneously with the development by using the developing device.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 282444/2010 filed Dec. 17, 2010, which is hereby incorporated by reference.

What is claimed is:

1. An image forming apparatus comprising:

a rotatable photosensitive member;

a charging member for electrically charging said photosensitive member in contact or proximity to said photosensitive member, wherein said charging member forms an upstream gap and a downstream gap between said photosensitive member and itself, with respect to a movement direction of said photosensitive member, so that the upstream gap is gradually narrowed toward a contact portion or a closest position between said photosensitive member and itself and so that the downstream gap is gradually widened with a distance from the contact portion or the closest position;

a power source for applying a DC voltage to said charging member;

irradiation means for irradiating with light a surface of said photosensitive member in the upstream gap; and control means for controlling the irradiation of the light by said irradiation means, wherein said photosensitive member is movable at a first speed and a second speed slower than the first speed, and wherein the irradiation of the light by said irradiation means is effected when said photosensitive member is moved at the first speed to effect image formation, and is not effected when said photosensitive member is moved at the second speed to effect the image formation.

2. An image forming apparatus according to claim 1, further comprising adjusting means for adjusting the DC voltage applied from said power source to said charging member depending on whether or not the irradiation of the light by said irradiating means is effected.

3. An image forming apparatus according to claim 2, wherein said adjusting means adjusts the DC voltage applied to said charging member so that a charge potential after said photosensitive member charged by said charging member is moved by a predetermined distance is a predetermined potential.

4. An image forming apparatus according to claim 1, further comprising environment detecting means for detecting a temperature and/or humidity in said image forming apparatus, wherein when a measurement result of the temperature and/or humidity in said image forming apparatus is a predetermined value or more, said control means effects control so that the irradiation of the light by said irradiating means is not effected even when said photosensitive member is moved at the first speed to effect the image formation.

5. An image forming apparatus according to claim 1, further comprising adjusting means for adjusting the DC voltage applied to said charging member so that a charge potential after said photosensitive member charged by said charging member is moved by a predetermined distance is a predetermined potential.

* * * * *